US006240758B1

(12) United States Patent
Nagakura

(10) Patent No.: US 6,240,758 B1
(45) Date of Patent: Jun. 5, 2001

(54) HYDRAULIC MACHINE

(75) Inventor: Seiju Nagakura, Aichi (JP)

(73) Assignee: Toyokoki Co., Ltd., Aichi (JP)

( * ) Notice: Subject to any disclaimer, the term of this patent is extended or adjusted under 35 U.S.C. 154(b) by 0 days.

(21) Appl. No.: 09/334,514

(22) Filed: Jun. 21, 1999

(51) Int. Cl.[7] ..... B21D 5/00; B21J 9/20

(52) U.S. Cl. ..... 72/20.1; 72/16.9; 72/18.8; 72/21.4; 72/453.02; 72/453.07; 72/453.08

(58) Field of Search ..... 72/453.08, 453.07, 72/453.06, 453.02, 16.9, 18.8, 20.1, 21.4

(56) References Cited

U.S. PATENT DOCUMENTS

| | | | | |
|---|---|---|---|---|
| 3,691,946 | * | 9/1972 | Ando | 72/453.07 |
| 3,871,202 | * | 3/1975 | Claesson | 72/453.02 |
| 4,125,010 | * | 11/1978 | Adam | 72/453.06 |
| 4,235,088 | * | 11/1980 | Kreiskorte | 72/453.18 |

FOREIGN PATENT DOCUMENTS

| | | | | |
|---|---|---|---|---|
| 2124800 | * | 2/1984 | (GB) | 72/453.06 |
| 10180499 | | 7/1998 | (JP) . | |

* cited by examiner

*Primary Examiner*—David Jones
(74) *Attorney, Agent, or Firm*—Jordan and Hamburg LLP

(57) ABSTRACT

A hydraulic machine for operation such as for pressurizing a workpiece and molding products from materials by using a reciprocation mechanism comprising a hydraulic cylinder unit. The cylinder unit comprises two types cylinder chambers having different cross-sectional areas, and a third or plural cylinder chambers. Hydraulic oil sent out from a hydraulic pump driven by a servo motor, is fed through a hydraulic circuit into the cylinder unit. The shifting position of the reciprocation movement is detected, and path switching in the hydraulic circuit and revolving operation of the servo motor are controlled on the basis of the detected shifting position. In case the reciprocation movement is used for pressurizing a workpiece by a die, the hydraulic oil is fed to the cylinder chamber for forward of small cross-sectional area until slightly before the die comes into contact against the workpiece, and the die shifts at high speed relative to a workpiece. Subsequently, the path switching is done to lead the hydraulic oil into the cylinder chamber of large cross-sectional area, and the die moves at a low speed relative to the workpiece.

14 Claims, 18 Drawing Sheets

HYDRAULIC MACHINE

BACKGROUND OF THE INVENTION

The present invention relates to a hydraulic machine such as a press machine, an injection molding machine, and a die-cast machine in which hydraulic oil sent out from a hydraulic pump is fed through a hydraulic circuit to a cylinder chamber of a reciprocation mechanism to actuate the reciprocation mechanism for reciprocation. In particular, the invention relates to a hydraulic machine in which hydraulic oil is fed to some of a plurality of cylinder chambers in a reciprocation mechanism to reciprocate a die and the like, so as to apply pressure to a workpiece for the bending.

In a conventional typical press brake, a lower die having a V-shaped groove is mounted on a table, and an upper die is attached via a holder to the lower end of a ram so that the both dies are opposed to each other. On the lower die is supported a workpiece plate form, to which the upper die is moved up and down together with the ram. In descending, the upper die applies a pressure force onto the workpiece to press the workpiece into the aforesaid V-shaped groove, thereby bending the workpiece at a prescribed bending angle.

The bending angle of workpiece depends on the lowering terminal position of the upper die. The lowering terminal position, i.e., the stroke of the upper die can be changed to set the bending angle of the workpiece to a desired value.

Press brakes for use in such bending with the aim of realizing both the speed-up of the bending operation and the improvement in precision of the bending at the same time include that of a hydraulic drive system in which a hydraulic cylinder is used as the drive unit of a ram, and that of a motor drive system in which a servomotor is used as the drive unit of the ram.

In the press brake of a hydraulic drive system, servo valves and relief valves are interposed in a hydraulic circuit for feeding hydraulic oil from the hydraulic pump to the hydraulic cylinder. The aforesaid servo valves are actuated to control the feeding route and the feeding amount of the hydraulic oil to the hydraulic cylinder, thereby realizing the up-and-down movements of the upper die and carrying out the speed control and the position control of the upper die as well.

Meanwhile, in the press brake of a motor drive system, a feed screw for moving the ram up and down is connected to a servomotor so as to provide a certain speed reduction ratio. The servomotor can be controlled in number and direction of revolutions to realize the up-and-down movements of the upper die and carry out the speed control and the position control of the upper die as well.

In recent years, press brakes are strongly desired for higher performances. In this view, approaches have been made by the inventor of the present invention in order to realize the further speed-up of the bending operation and the further improvement in precision of the bending.

On press brakes of the hydraulic drive system, studies were made as to the use of a double cylinder which comprises a first cylinder chamber of large cross-sectional area for actuating the upper die at a low speed and a second cylinder chamber of small cross-sectional area for actuating the upper die at a high speed.

On press brakes of the motor drive system, studies were made as to the incorporation of two types of speed reducing mechanisms and a clutch mechanism into the drive mechanism. Here, the aims of the two types of speed reducing mechanisms are to set the speed (i.e., number of revolutions) of the aforesaid feed screw at two levels of high and low speeds, respectively, and the clutch mechanism is to switch the speed reducing mechanisms.

Each of the approaches has brought some degree of results in improving the performance of the press brakes. However, in the press brake of the hydraulic drive system, the hydraulic circuit needs to be improved in responsivity to secure the positioning accuracy of the ram and to shorten the positioning time. This requires the maintenance of a large differential pressure across the upstream side of the servo valve into which the hydraulic oil inflows and the downstream side of the servo valve from which the hydraulic oil outflows, resulting in a greater energy loss. The energy loss is also generated when an excess of the hydraulic oil at the upstream side is returned via the relief valve to a tank as well as when the hydraulic oil is sent through the servo valve. The aforesaid energy loss is converted into thermal energy producing a rise in temperature and a change in viscosity of the hydraulic oil, leading to a problem of adversely affecting the servo control.

Meanwhile, in the press brake of the motor drive system, the two types of speed reducing mechanisms and the clutch mechanism need to be incorporated into one drive mechanism. This complicates the configuration of the drive mechanism to a large extent, giving rise to a problem in increased size and cost of the drive mechanism.

SUMMARY OF THE INVENTION

The present invention is achieved in view of the foregoing problems, and an object thereof is to enable a switching of a reciprocation mechanism between high and low speeds to realize further speed-up of operation and improvement in precision without producing problems in energy loss and in complication and bulking-up of a drive mechanism's configuration.

To realize the above object, a hydraulic machine according to an embodiment of the invention comprises:

- a reciprocation mechanism comprising a cylinder unit which has two cylinder chambers a first chamber and a second chamber for forward movement having different cross-sectional areas, and a third cylinder chamber for backward movement;
- a hydraulic circuit comprising a plurality of paths for feeding hydraulic oil into the respective cylinder chambers in the cylinder unit; a hydraulic pump for sending hydraulic oil to the hydraulic circuit; a servo motor for driving said hydraulic pump;
- a position detecting means for detecting a shifting position of a reciprocation movement due to the reciprocation mechanism; and a control means for controlling path switching in the hydraulic circuit, as well as revolving operation of the servo motor, using the value detected by the position detecting means.

Note that the above constitution is introduced in a press brake for bending a workpiece by a press force of a die, for example. The hydraulic oil sent out from the hydraulic pump is fed to the cylinder chamber, for forward movement, having a small cross-sectional area until slightly before the die comes into contact against the workpiece whereby the die shifts at a high speed relative to the workpiece. Subsequently, when the die has reached a position slightly before contacting the workpiece, the path switching is done in the hydraulic circuit to lead the hydraulic oil into the cylinder chamber, for forward movement, having a large cross-sectional area, whereby the die moves at a low speed relative to the workpiece. In this case, the shifting position of the die is detected by the position detecting means, and the revolving operation of the servo motor is controlled on the basis of the detected position for carrying out the position control and the speed control for the die. It becomes possible to realize increased speed and improvement in precision of the press operation at the same time.

Furthermore, in improving performance of the press brake comprising the above structure, both an energy loss problem, a problem of thermal energy producing a rise in temperature and a change in viscosity of the hydraulic oil due to the energy loss are improved, as in the aforesaid hydraulic drive system using a servo valve. The amounts of the hydraulic oil fed into the respective cylinder chambers are controlled by the hydraulic pump, so the change in viscosity has little effect on the feeding amount of the oil, compared to the feeding amount controlled by the servo valve in which the feeding amount of the hydraulic oil is controlled by a space of the oil feeding path. Therefore, even if the temperature of the hydraulic oil is risen for any reason, the amount of the hydraulic oil fed into the cylinder chambers is stabally controlled.

Moreover, both a problem of a complicated structure and an increased size of the drive mechanism are improved, as in the aforesaid motor drive system.

Next, another aspect of the hydraulic machine comprises: a reciprocation mechanism comprising a pair of cylinder units which are arranged at symmetrical positions on both sides of the machine; each cylinder unit has the same structure as the first embodiment; a pair of hydraulic circuits connected with the cylinder units respectively, each circuit comprises a plurality of paths for feeding hydraulic oil into the respective cylinder chambers in the corresponding cylinder unit; a pair of hydraulic pumps for sending hydraulic oil to the hydraulic circuits respectively; a pair of servo motors for driving the hydraulic pumps respectively; a position detecting means for detecting shifting positions of reciprocation movement due to the reciprocation mechanism on both sides corresponding to the positions where the cylinder units are arranged; and a control means for controlling individually path switching in the respective hydraulic circuits, as well as revolving operations of the respective servo motors, by using the values detected by the position detecting means.

According to this structure, the cylinder units are arranged at symmetrical positions on both sides of the machine wherein each unit comprises two cylinder chambers for forward movement having different cross-sectional areas and a cylinder chamber for backward movement, and the introduction of the hydraulic oil into the respective cylinder chambers is controlled individually. So even if the workpiece were set in an unsymmetrical state with respect to a machine center, it becomes possible to bend the workpiece at a proper angle throughout a whole length thereof.

Furthermore, an aspect of a hydraulic machine further comprises a pressure force detecting means for detecting a pressure force (or pressing forces on both sides) effected by the die on the workpiece; a thickness detecting means for detecting the contact of the die against the workpiece by comparing the value(s) detected by the pressurizing force detecting means with a prescribed threshold, and detecting the thickness of the workpiece by using the value(s) detected by said position detecting means on detecting the contact of the die against the workpiece. And the control means determines the terminal shift position of the die according to a thickness of the workpiece detected by said thickness detecting means, and stops the revolution(s) of the servo motor(s) when the value(s) detected by the position detecting means arrives at the terminal shift position.

Accordingly, the thickness of the workpiece is detected by the detected shifting position on detecting the contact of the die against the workpiece, and the terminal shift position is determined on the basis of the thickness. So even if thickness varies in the workpieces, all of the workpieces can be bent at the same angle.

Note that the present invention is applicable to not only to press brakes but also any other press machines. Besides, the present invention is applicable to not only press machines but also any other hydraulic machines, and in particular to injection molding machines and die-cast machines for molding products from materials of molten resins and molten metals using dies.

An example is a typical injection molding machine, which molds a product of desired shape by injecting molten resins into a cavity of closed dies which comprises some clamping mechanism to prevent the high-pressured molten resins from leaking out of the dies. The clamping mechanism contains a hydraulic cylinder as its reciprocation mechanism, and hydraulic oil sent out from a hydraulic pump is fed through a hydraulic circuit into cylinder chambers in the aforesaid hydraulic cylinder.

The present invention is applicable to such clamping mechanism of an injection molding machine, so that the aforesaid reciprocation mechanism uses a hydraulic cylinder comprising two cylinder chambers for forward movement and a cylinder chamber for backward movement, and is provided with the same hydraulic circuit, hydraulic pump, servomotor, position transducer, and control means as those in the above-mentioned embodiment of the press brake.

DETAILED DESCRIPTION

Figure 1:
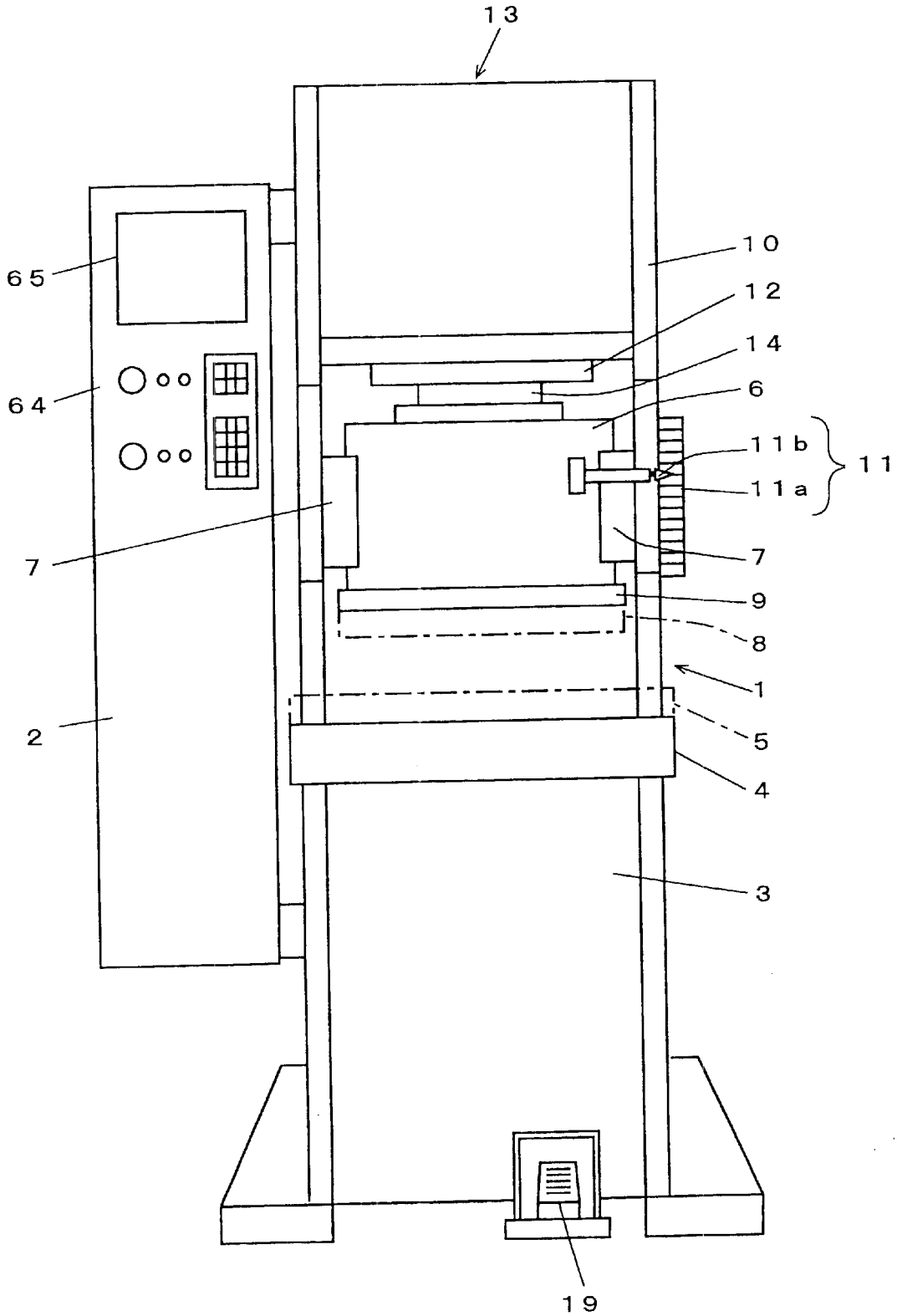
FIG. 1 is a front view showing an appearance of a press brake according to an embodiment of the invention.

FIG. 1 shows an external view of a press brake of a first embodiment of the present invention, in which an electric control box 2 is provided integrally on a side of a machine body 1 to be installed on a floor.

In a front side of the machine body 1, a table 4 for supporting a lower die 5 is mounted on a bed 3, and over the table 4 is arranged a ram 6 so as to be lifted up and down along guides 7. On a lower end of the aforesaid ram 6 is mounted an upper die 8 via a holder 9. The upper die 8 is lowered against a workpiece plate supported on the lower die 5 so that a pressure is imposed to bend the workpiece.

The bed 3 is equipped with a foot switch 19 at a front lower portion thereof. The foot switch 19 is stepped on by an operator to move the ram 6 up and down.

Note that, while the press brake in the illustrated example is a system wherein the upper die 8 is moved up and down, the present invention is not limited thereto, and may be applied to a press brake of a system in which the lower die 5 is operated to move up and down.

Between the ram 6 and a frame 10 of the machine body 1 is arranged a position transducer 11 for detecting the vertical position of the ram 6.

In the present embodiment, the position transducer 11 uses a linear sensor, whose scale 11*a* and moving head 11*b* are attached to the frame 10 and the ram 6, respectively.

The moving head 11*b* moves together with the ram 6 up and down along the scale 11*a*, and outputs a pulsed signal as a detected position signal. The detected position signal is taken into a control unit (described later in detail) in the electric control box 2 for a count, and the vertical position of the ram 6 is obtained from the counted value.

The ram 6 is moved up and down by a reciprocation mechanism 13 which uses a hydraulic cylinder 12 as a drive source thereof.

The hydraulic cylinder 12 is supported by the frame 10 of the machine body 1, and is connected with the ram 6 at the lower end of its cylinder rod 14 protruding downward.

Note that, while the reciprocation mechanism 13 in the illustrated example uses one hydraulic cylinder 12 as its drive source, two or more hydraulic cylinders may be used for the drive source, as described later.

Figure 2:
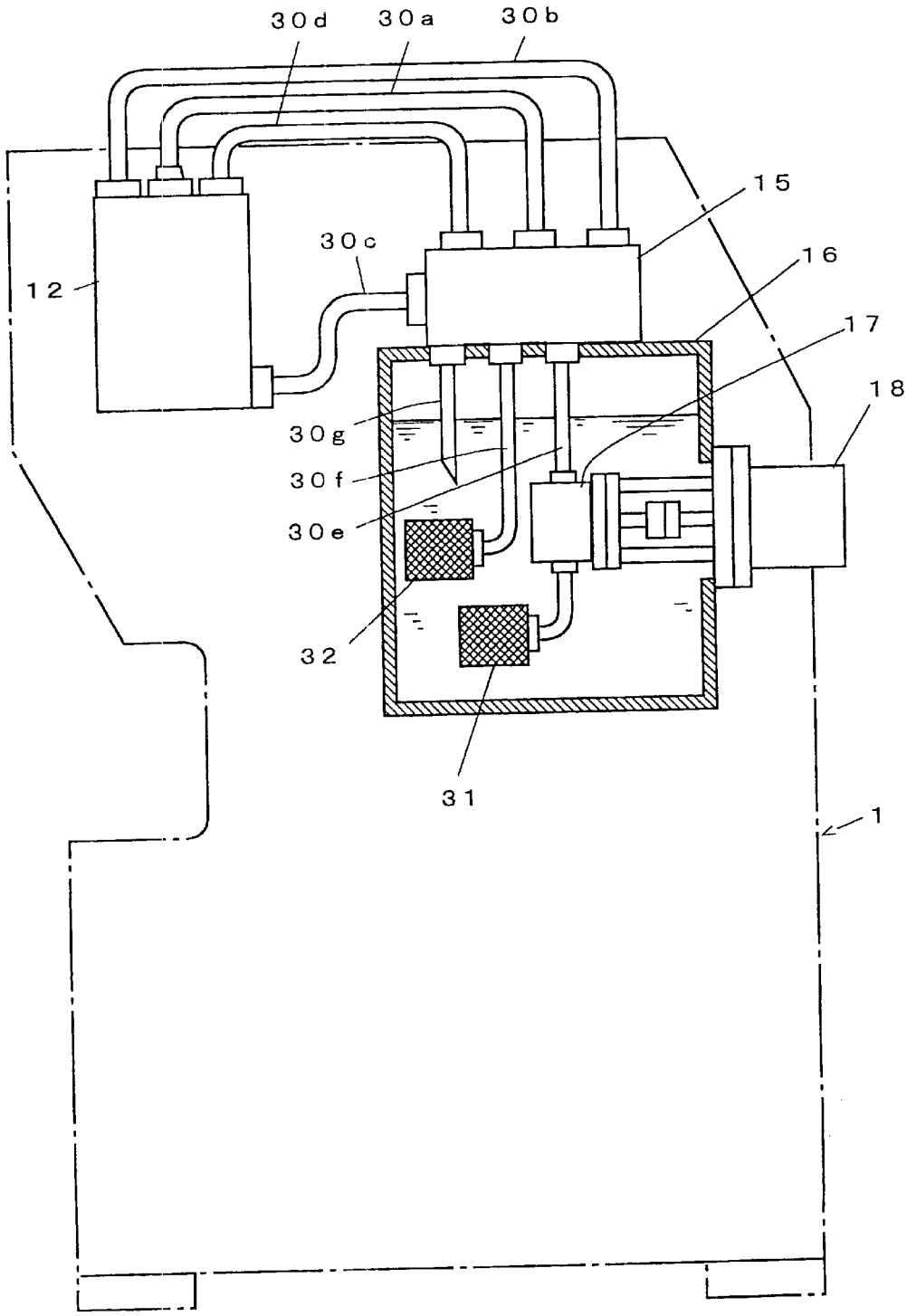
FIG. 2 is a connection diagram of a hydraulic cylinder and a tank, and constitution inside the tank.

As shown in FIG. 2, the hydraulic cylinder 12 is connected with a manifold block 15 via four hydraulic pipes 30*a* to 30*d*. The manifold block 15 has valves, discussed below, built in. A tank 16, integrally attached to the manifold block 15, is equipped with a hydraulic pump 17 and an alternating-current (ac) servomotor 18 as a driving source of the hydraulic pump 17, so as to constitute a hydraulic circuit 40.

The aforesaid tank 16 holds hydraulic oil. Three hydraulic pipes 30*e* to 30*g* provided on the manifold block 15 are extended into the tank 16 so that the respective extremities thereof are immersed into the hydraulic oil.

Figure 3:
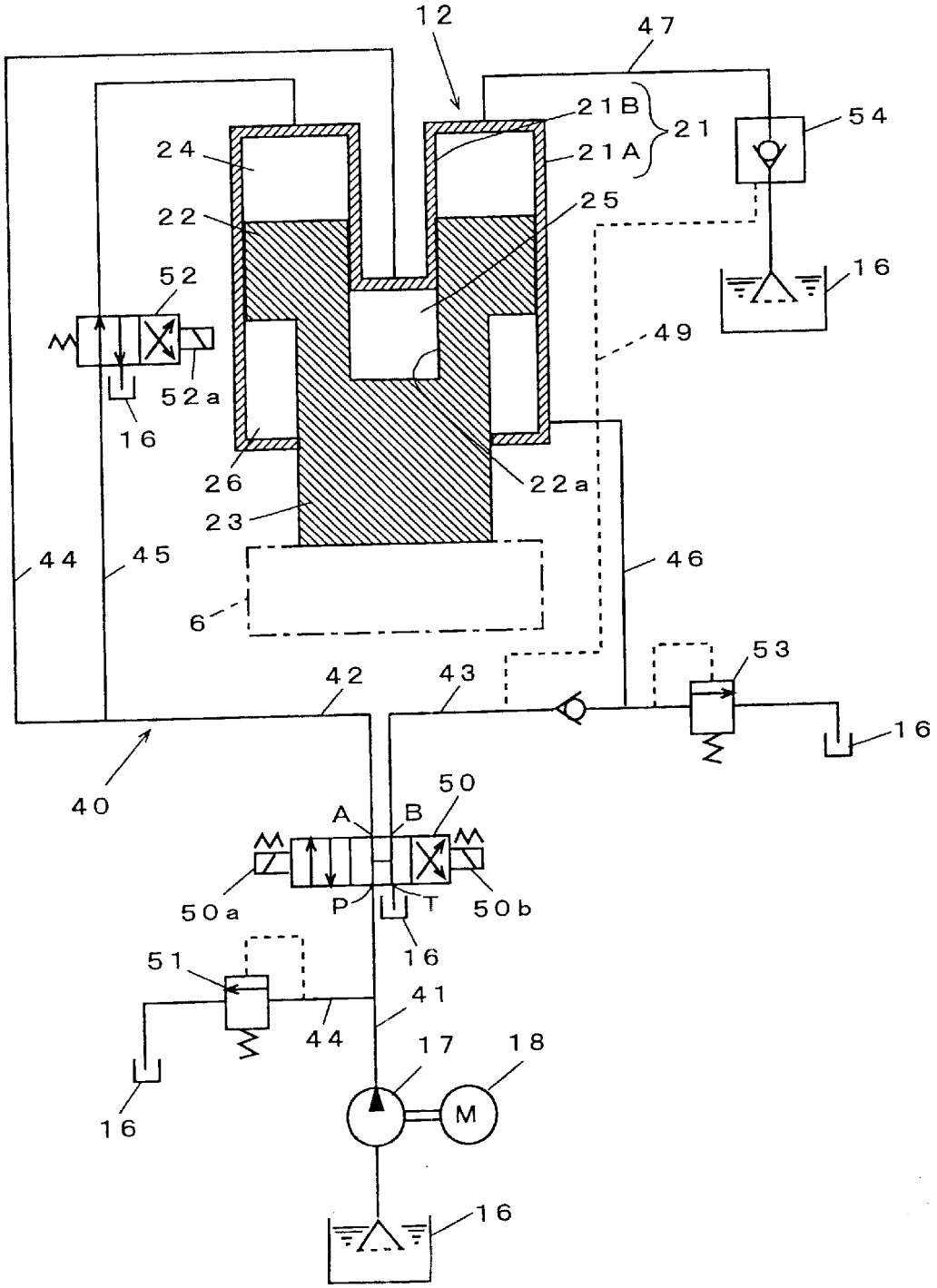
FIG. 3 is a circuit diagram of a hydraulic circuit installed in the press brake.

As shown in FIG. 3, the hydraulic cylinder 12 is composed of a cylinder case 21 having a tubular inner wall 21B inside a tubular outer wall 21A, a piston 22 arranged in the cylinder case 21 so as to be capable of reciprocation, and a piston rod 23 integrally formed on the piston 22.

The piston 22 is of ring shape in which an external diameter thereof is approximately the same as an internal diameter of the tubular outer wall 21 A of the cylinder case 21, and an internal diameter of an inner hole 22*a* is approximately the same as an external diameter of the tubular inner wall 21B.

The piston rod 23 is formed so that an external diameter is smaller than an internal diameter of the tubular outer wall 21A of the cylinder case 21, and is projected downward beyond a lower end surface of the cylinder case 21.

Inside the aforesaid cylinder case 21 are formed a first cylinder chamber 24 for forward movement having a large cross-sectional area, a second cylinder chamber 25 for forward movement having a small cross-sectional area, and a third cylinder chamber 26 for backward movement. The first cylinder chamber 24 for forward movement is formed in a place above the aforesaid piston 22 between the tubular outer wall 21A and the tubular inner wall 21B, the second cylinder chamber 25 for forward movement formed inside the inner hole 22*a* of the piston 22, and the third cylinder chamber 26 for backward movement is formed below the piston 22 around the piston rod 23, respectively.

In lowering the ram 6 at a high speed, hydraulic oil is fed into the second cylinder chamber 25 for forward movement. In lowering the ram 6 at a low speed, hydraulic oil is fed into both the first and second cylinder chambers 24 and 25. In raising the ram 6, hydraulic oil is fed into the third cylinder chamber 26.

Returning to FIG. 2, among the four hydraulic pipes 30*a* to 30*d* providing connection between the hydraulic cylinder 12 and the manifold block 15: the first hydraulic pipe 30*a* is to feed hydraulic oil to the second cylinder chamber 25 of the hydraulic cylinder 12; the second hydraulic pipe 30*b* is to feed hydraulic oil to the first cylinder chamber 24 of the hydraulic cylinder 12; the third hydraulic pipe 30*c* is to feed hydraulic oil to the third cylinder chamber 26 for backward movement; and the fourth hydraulic pipe 30*d* is to introduce hydraulic oil from the tank 16 to the first cylinder chamber 24 in lowering the ram 6 at a high speed.

Of the three hydraulic pipes 30*e* to 30*g* extended from the manifold block 15 into the tank 16: the fifth hydraulic pipe 30*e* is to send out hydraulic oil held in the tank 16 by means of the hydraulic pump 17; the sixth hydraulic pipe 30*f* is to suck up the hydraulic oil held in the tank 16; and the seventh hydraulic pipe 30*g* is to return hydraulic oil into the tank 16.

In the figure, designated by the reference numerals 31 and 32 are strainers attached to the extremities of the fifth and sixth hydraulic pipes 30*e* and 30*f*, respectively.

FIG. 3 shows the aforementioned hydraulic circuit 40 of the press brake.

In the hydraulic circuit 40 of the illustrated example, an oil feeding channel 41 for sending out hydraulic oil using the hydraulic pump 17 is connected with a first and second paths 42 and 43 via a first solenoid change-over valve 50. The ac servomotor 18 is revolution controlled to control the drive of the pump 17.

On the oil feeding channel 41 is provided a branch channel 44 having a relief valve 51. The relief valve 51 is set for the maximum pressure of the hydraulic circuit 40.

In the first solenoid change-over valve 50 at its neutral position, hydraulic oil fed into the P port is let through the T port of the lowest pressure, and is returned into the tank 16.

The first solenoid change-over valve 50 is operated by two electromagnetic solenoids 50*a* and 50*b* to effect change over. When the first solenoid 50*a* is energized, hydraulic oil is let from the P port through the A port into the first path 42. When the second solenoid 50*b* is energized, hydraulic oil is let from the P port through the B port into the second path 43.

The first path 42 is branched into a third path 44 and a fourth path 45, which are connected to the second cylinder chamber 25 and the first cylinder chamber 24, respectively. The fourth path 45 has a solenoid change-over valve 52 interposed on the way. When an electromagnetic solenoid 52*a* in this valve 52 is energized, only the third path 44 is left in communication with the hydraulic cylinder 12. Through the third path 44, hydraulic oil is fed into the cylinder chamber 25 of a smaller cross-sectional area among the two cylinder chambers for forward movement, 24 and 25, to lower the ram 6 at a high speed.

In the descending of the ram, hydraulic oil flows out from the third cylinder chamber 26 of the hydraulic cylinder 12. The outflowing hydraulic oil is let through the fifth path 46, and returned to the tank 16 via the relief valve 53. Here, the relief valve 53 is set in pressure so as to support the weights of the ram 6, the holder 9, and the upper die 8.

When the ram 6 is lowered at a high speed, the cylinder chamber 24 of a larger cross-section area than cylinder chamber 25 is vacuumed. Here, on the sixth path 47 connected to the cylinder chamber 24 is interposed a check valve 54 of pilot type having its cracking pressure set at a value sufficiently smaller than the atmospheric pressure. Accordingly, through the check valve 54, a required amount of hydraulic oil flows into the first cylinder chamber 24 from the tank 16. In this connection, designated by the reference numeral 49 in the figure, is a pilot line.

Meanwhile, when the solenoid 52*a* in the solenoid change-over valve 52 is de-energized, both the third and fourth paths 44 and 45 communicate with the hydraulic cylinder 12. Here, hydraulic oil is fed through the third and fourth paths 44 and 45 into both the cylinder chambers for forward movement 24 and 25, lowering the ram 6 at a low speed.

When the second solenoid 50*b* in the first solenoid change-over valve 50 is energized, hydraulic oil is released from the P port through the B port to the second path 43, and then introduced through the fifth path 46 into the third cylinder chamber 26, for backward movement, in the hydraulic cylinder 12. In this case, an increased pilot pressure opens the check valve 54 on the sixth path 47, so that hydraulic oil flows out from the first cylinder chamber for forward movement 24 of the hydraulic cylinder 12 and returns to the tank 16 through the check valve 54.

Figure 4:
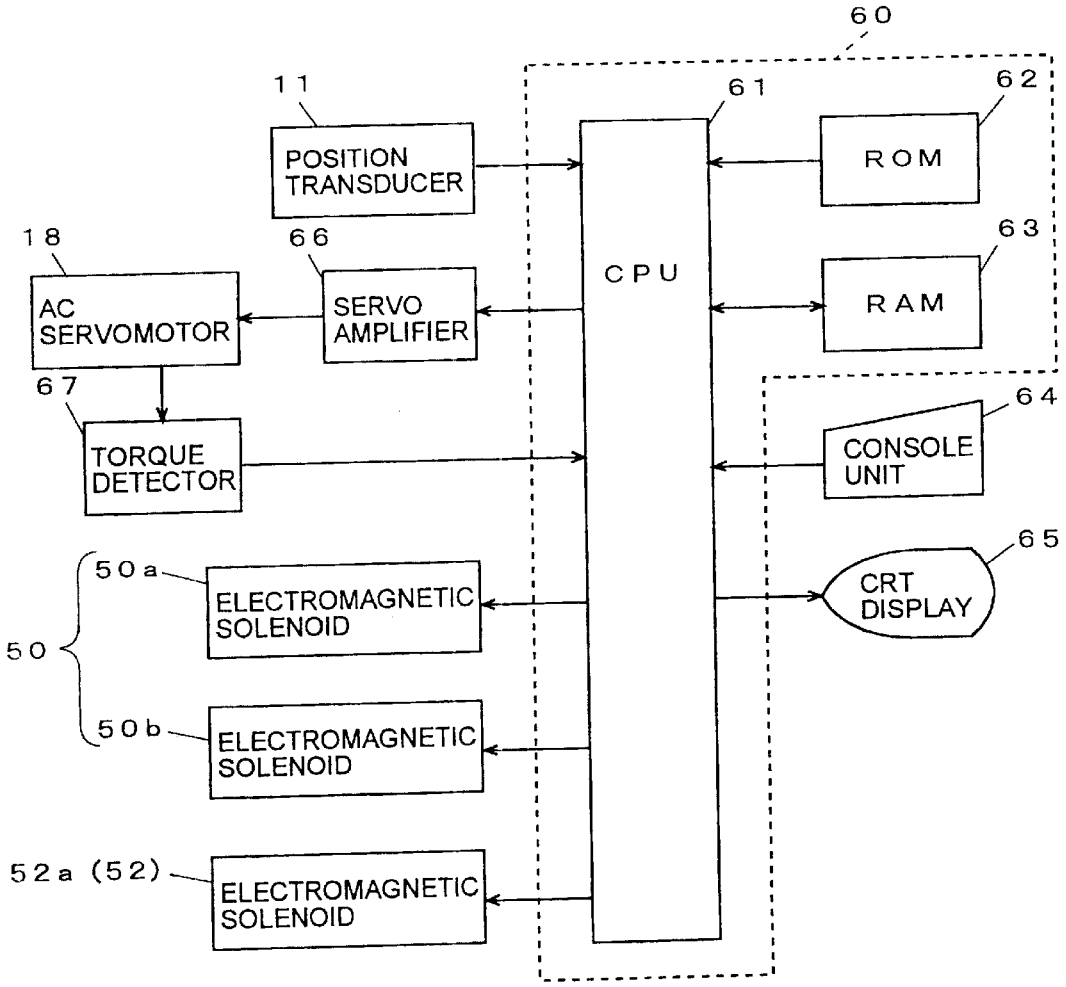
FIG. 4 is a block diagram of an electrical constitution according to a first embodiment.

FIG. 4 shows an example of electrical constitution of the above-described embodiment.

In the figure, designated by the reference numeral 60 is the control unit installed in the aforesaid electric control box 2. The control unit 60 is constituted by a microcomputer, which comprises a CPU 61, a ROM 62, and a RAM 63. The CPU 61 serves for control and operation. The ROM 62 stores programs and the like for controlling the machine. The RAM 63 stores various data such as operation results, and user programs.

On the exterior of the aforesaid electric control box 2 is provided a console unit 64 and a CRT display 65. The console unit 64 is equipped with various switches, keys, and the like for use in operating the machine and inputting data.

The CPU 61 supplies a servo amplifier 66 with an output for the ac servomotor 18. The servo amplifier 66 amplifies the output, and feeds it to the servomotor 18. The servomotor 18 is connected to a torque detector 67. The torque detector 67 constitutes a force detecting means for detecting the pressure of the upper die 8 against a workpiece, monitors current flowing through the servomotor 18 to detect the torque.

The CPU 61 receives from the position transducer 11 a pulsed signal as the position detecting signal. The CPU 61 counts the number of pulses to detect the vertical position of the ram 6.

The CPU 61 outputs drive control signals for controlling the operations of the electromagnetic solenoids 50*a*, 50*b* in the aforesaid first solenoid change-over valve 50 and the electromagnetic solenoid 52*a* in the second solenoid change-over valve 52.

Figure 5:
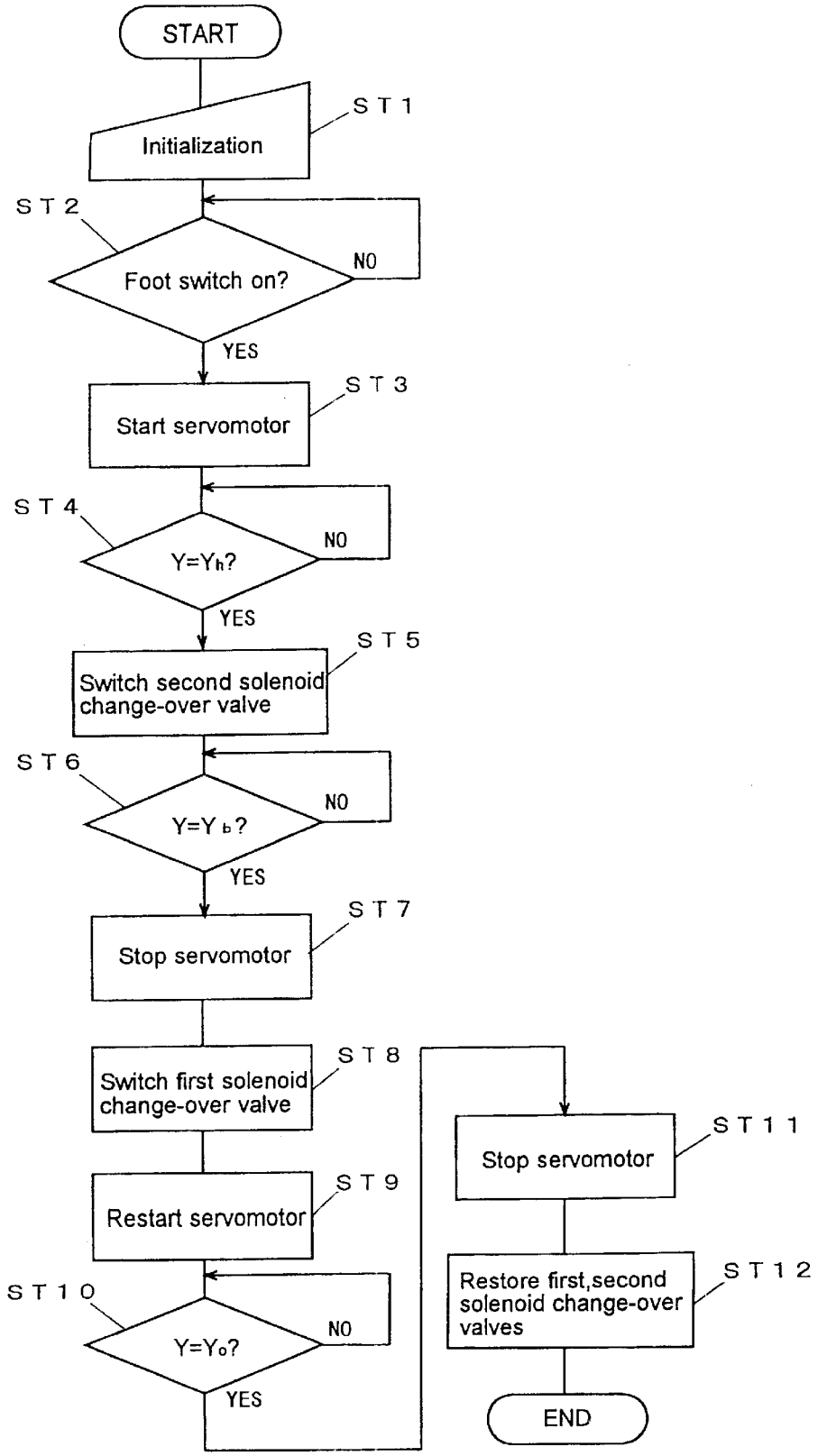
FIG. 5 is a flow chart showing procedures of control by a control unit of the first embodiment.

FIG. 5 shows a flow of control by the control unit 60. In the figure, "ST" represents a step.

At ST1 in the figure, in advance of the bending, an operator inputs prescribed data via the console unit 64 to carry out initialization. The prescribed data include, for example, a lowering terminal position Yb and a speed switching position Yh of the ram 6 corresponding to the bending angle of a workpiece. These input data are taken into the CPU 61, and then stored in the RAM 63.

Figure 6:
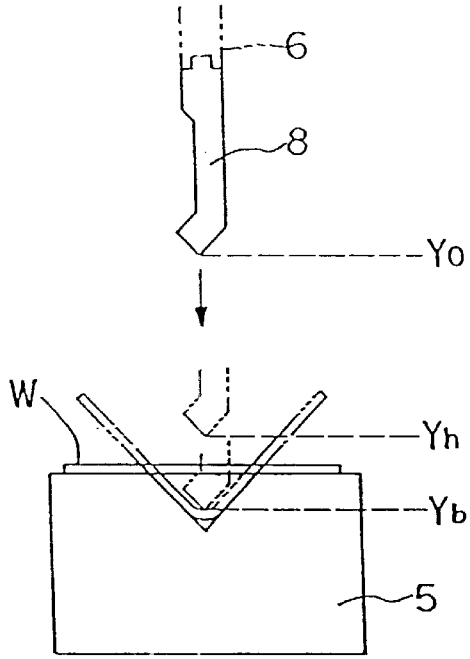
FIG. 6 is a front view showing relationship in positions between a upper die and a workpiece under the control of the first embodiment.

In standby, as shown in FIG. 6, the upper die 8 and the ram 6 are positioned in a standby position $Y_0$ at the top. When the operator steps the foot switch 19 to operate, the ac servomotor 18 is rotated to drive the hydraulic pump 17, putting the upper die 8 into descending action (ST2,3).

In the descending action of the ram 6, until slightly before the upper die 8 comes into contact against a workpiece W, the hydraulic oil fed from the hydraulic pump 17 is released through the oil feeding channel 41, the first path 42, and the third path 44 of the hydraulic circuit 40 into the second cylinder chamber 25. Thereby, the upper die 8 is lowered at a high speed.

Here, the descending position Y of the upper die 8 is continuously monitored by the position transducer 11. The CPU 61 in the control unit 60 obtains position detecting signals from the position transducer 11, and controls the revolving operation of the servomotor 18 to carry out the position control and the speed control for the upper die 8.

On detection from a position detecting signal of the position transducer 11 that the upper die 8 has reached the speed switching position $Y_h$ slightly before contacting against the workpiece W, the CPU 61 actuates the solenoid change-over valve 52 to change over (ST4,5). By this means, the hydraulic oil fed from the hydraulic pump 17 is let from the first path 42 through both the third and fourth paths 44,45, and introduced into both the first and second cylinder chambers 2 for forward movement 24, 25 in the hydraulic cylinder 12. This actuation switches the descending action of the upper die 8 from a high speed to a low speed.

Immediately after the transition of the descending action to the low speed, the upper die 8 comes into contact against the workpiece W. Then, the workpiece W is bent between the pressure force from the upper die 8 and a reactive pressure force from the lower die 5.

On detection from a position detecting signal of the position transducer 11 that the descending position Y of the upper die 8 reaches the lowering terminal position $Y_b$, the CPU 61 stops the revolution of the ac servomotor 18 (ST6, 7). Here, in order to stop the revolution of the servomotor 18 just at the lowering terminal position $Y_b$, the CPU 61 gradually reduces the rotational speed of the servomotor 18 before the upper die 8 reaches the lowering terminal position $Y_b$. After a prescribed stop time at the lowering terminal position $Y_b$, the CPU 61 switches the solenoid change-over valve 50, and issues a rotation command to the servomotor 18 as well (ST8,9). The hydraulic oil from the hydraulic pump 17 is sent through the oil feeding channel 41 to the second path 43, and further sent through the fifth path 46 into the third cylinder chamber 26 for backward movement. This puts the upper die 8 into ascending action.

Subsequently, on detection from a position detecting signal of the position transducer 11 the fact that the upper die 8 is lifted up to the standby position $Y_0$, the CPU 61 stops the revolution of the servomotor 18 to stop the feeding of hydraulic oil from the hydraulic pump 17, and then operates the first and second solenoid change-over valves 50 and 52 for restoration to their initial states (ST10 to 12).

Note that, in the above-described embodiment, the lowering terminal position $Y_b$ of the upper die 8 is uniformly set in order to obtain the same bending angle from the same type of workpiece; however, not all workpieces can be bent in the same angle under the uniform setting of the lowering terminal position $Y_b$ of the upper die 8 in the cases where thickness thereof varies by workpiece.

Figure 7:
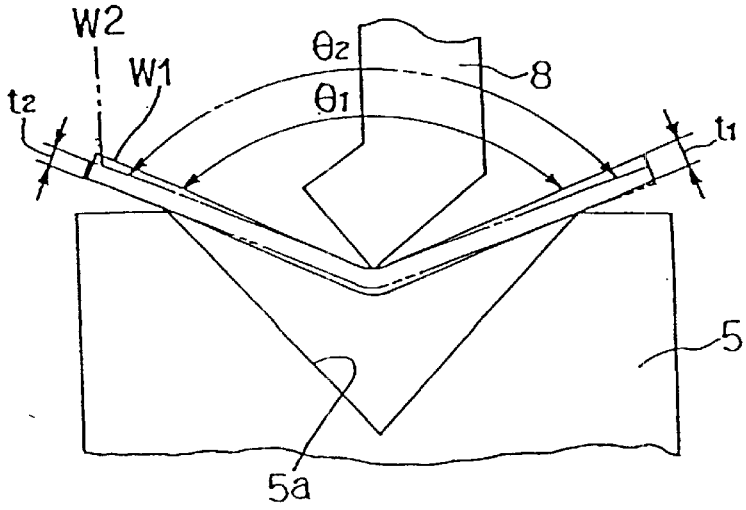
FIG. 7 is a view showing variation of bending angles of workpieces due to variations of their thickness.

FIG. 7 shows bending angles of workpieces varying due to a difference in thickness. In the figure, designated by 5 is a lower die, and 8 is an upper die. A workpiece W1 having a thickness of $t_1$ is pressed into a V-shaped groove 5*a* on the lower die 5 to bend under the force of the upper die 8. Here, the bending angle is shown by $\theta_1$.

On the contrary, in the case of a workpiece W2 (shown in dot-dashed lines) with a thickness of $t_2$ (where $t_2 < t_1$), the pressed amount of the workpiece W2 by the upper die 8 is smaller by the corresponding difference in thickness ($t_1 - t_2$); therefore, the bending angle $\theta_2$ is wider than the bending angle $\theta_1$ of the aforesaid workpiece W1.

Accordingly, in order to apply precise bending to a plurality of workpieces, it is required to detect the thickness of each workpiece and correct the lowering terminal position of the upper die 8 by the amount of error in thickness.

Figure 8:
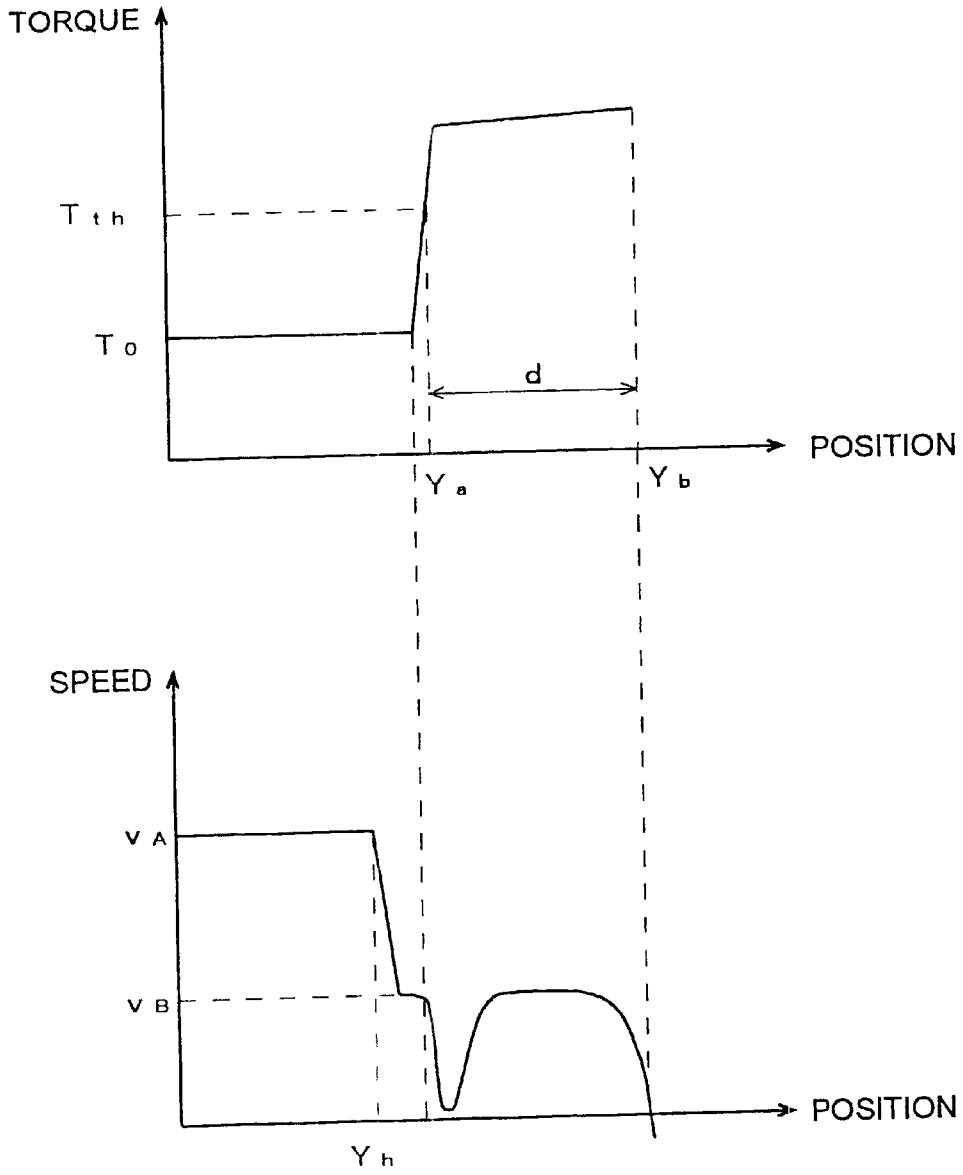
FIG. 8 is a graph showing a principle of detecting thickness of a workpiece.
Figure 9:
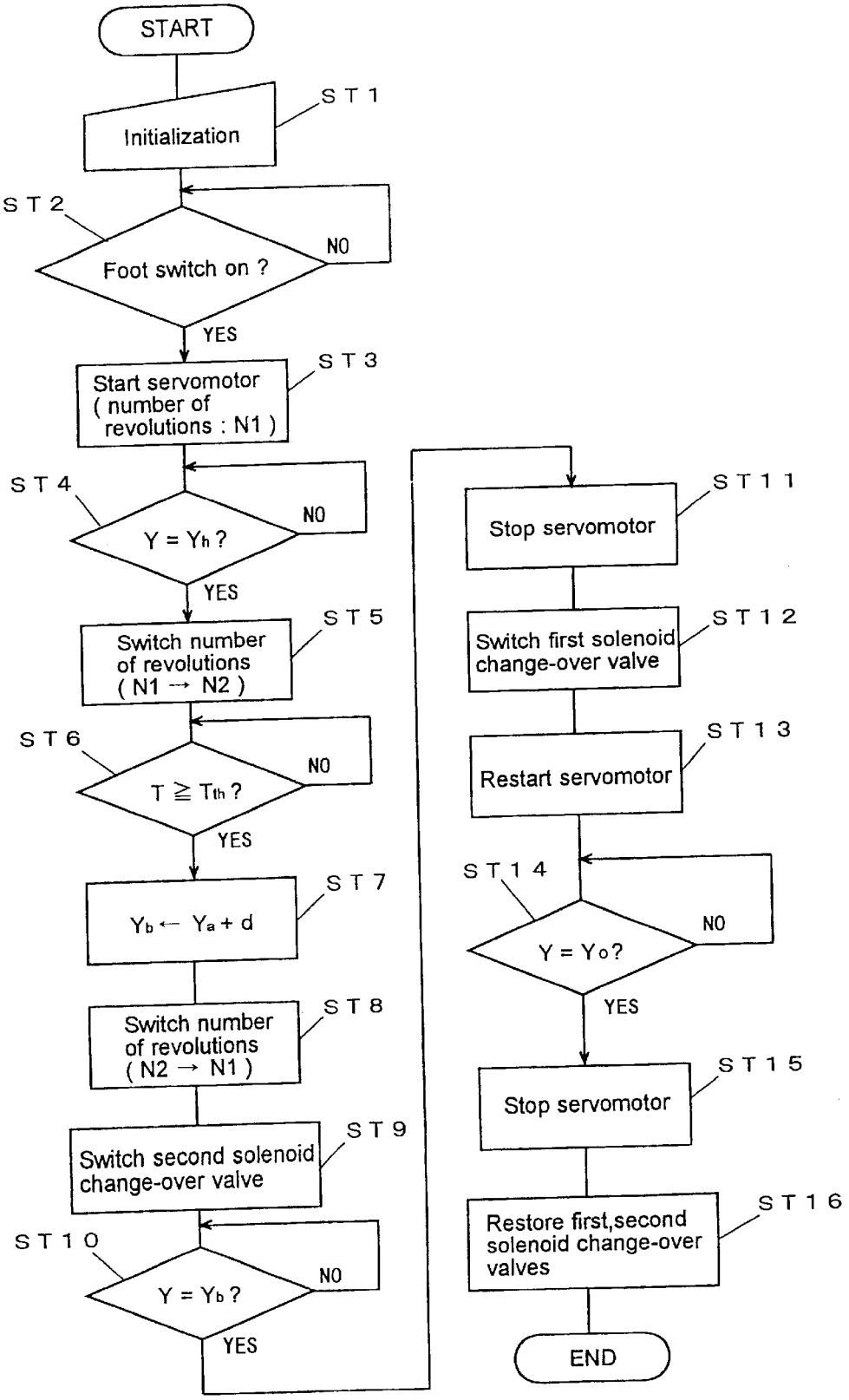
FIG. 9 is a flow chart showing procedures of control by a control unit of a second embodiment.

A second embodiment which will be described hereinafter has a function of detecting the thickness of a workpiece and a function of correcting the lowering terminal position of the upper die 8. FIG. 8 shows the principle of the thickness detection in the second embodiment, and FIG. 9 shows a control procedure of a press brake by the control unit 60 in the second embodiment. Note that the second embodiment is of the same hardware constitution as that shown in FIGS. 1 to 4, and description thereto will be omitted here.

In FIG. 8, the symbol $Y_a$ represents the contact position of the upper die 8 against a workpiece, and the symbol $Y_b$ the lowering terminal position of the upper die 8. At a stage before the arrival of the upper die 8 to the contact position $Y_a$ against the workpiece, the ac servomotor 18 exhibits a torque of small constant value $T_0$. The torque increases sharply when the upper die 8 comes to contact against the workpiece.

In this second embodiment, the torque of the servomotor 18 is detected by the torque detector 67; and when the detected value reaches a prescribed threshold value $T_{th}$, the CPU 61 determining that the upper die 8 is in contact with the workpiece. Then, the CPU 61 adds a pressing amount d of the upper die 8 for a desired bending angle to the contact position Y*a* of the upper die 8 to obtain the lowering terminal position $Y_b$ of the upper die 8.

In the second embodiment, while the upper die 8 is preparing to reach the speed switching position $Y_h$ just before contacting the workpiece, the hydraulic oil supplied from the hydraulic pump 17 is fed through the oil feeding channel 41, the first path 42, and the third path 44 of the hydraulic circuit 40 into the second cylinder chamber 25 to lower the upper die 8 at a high speed of $v_A$. Then, after the upper die 8 has reached the speed switching position Y*h*, just before contact with the workpiece, the rotation speed of the servomotor 18 is reduced so that the upper die 8 descends at a low speed of $v_B$.

In this low-speed descending, the upper die 8 comes into contact with the workpiece. Since in the low-speed descending the hydraulic oil is being fed to the second cylinder chamber 25 having the small cross-sectional area, a pressurizing force acting on the workpiece is small in value at the moment when the upper die 8 comes into contact with the workpiece. This, accordingly, solves a problem in that a thinner workpiece is deformed by a pressing force at the moment of contact.

Besides, when the upper die 8 is contacted with the workpiece, the upper die 8 receives a reactive force from the workpiece. This sharply reduces the descending speed of the upper die 8 down to zero or a value approximately zero, thereby improving the precision of the contact determination. Then, the second solenoid change-over valve 52 is switched to feed hydraulic oil into the first cylinder chamber 24 having the large cross-sectional area in the hydraulic cylinder 12. By this means, the workpiece is bent under a large pressure force, and the upper die 8 starts to descend again.

Next, referring to FIG. 9, a flow of control in the second embodiment will be described. In advance of the bending, an operator inputs prescribed data via the console unit 64 to carry out the initialization (ST1). The prescribed data include, for example, a threshold value $T_{th}$ for use in determining the contact of the upper die 8 with the workpiece, and a pressing amount d of the upper die 8 for obtaining a desired bending angle. These input data are taken into the CPU 61, and then stored in the RAM 63.

Figure 10:
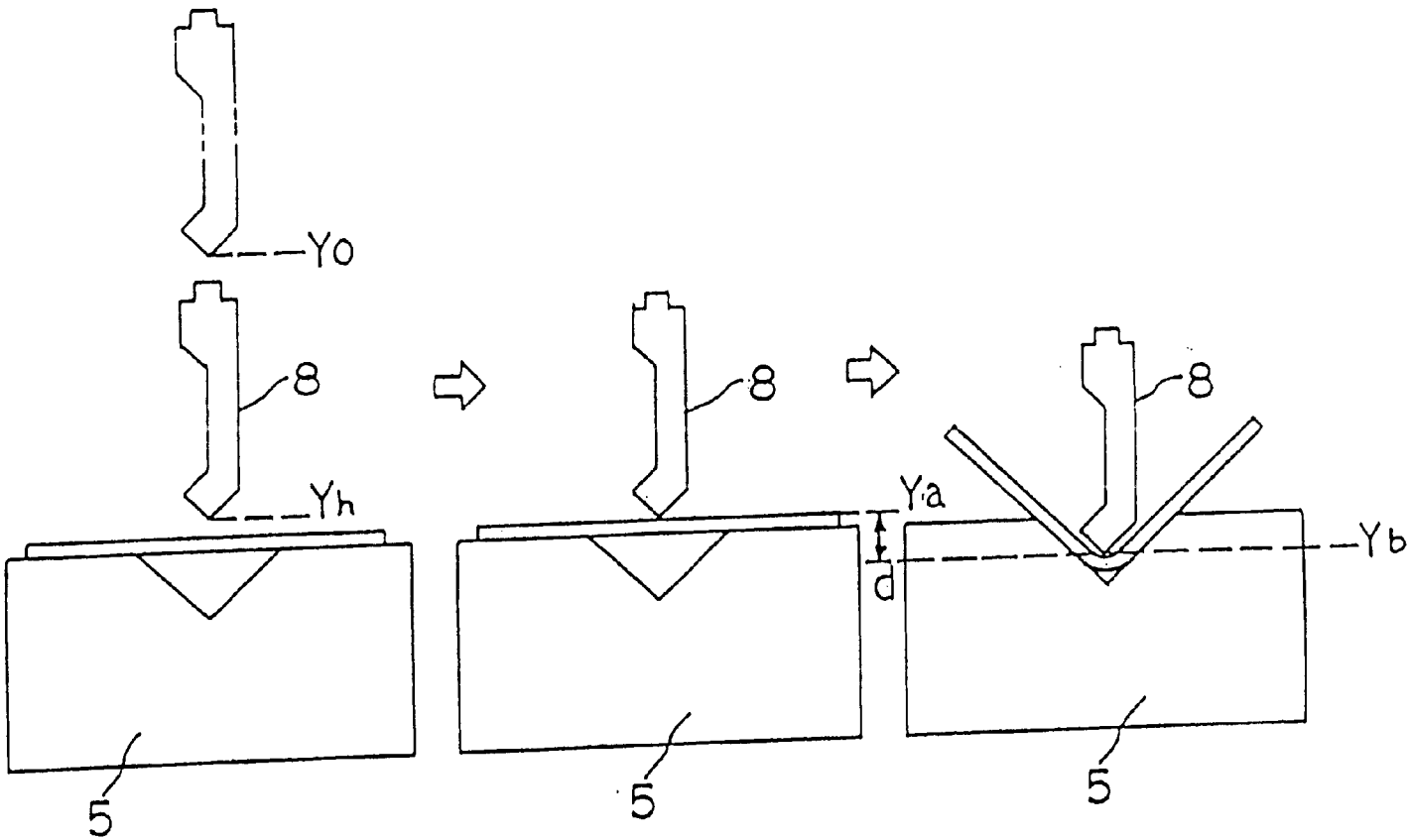
FIG. 10 is a front view showing relationship in positions between a upper die and a workpiece under control of the second embodiment.

In standby, as shown in FIG. 10, the upper die 8 and the ram 6 are positioned in a standby position $Y_0$ at the top. When an operator steps on the foot switch 19, the servomotor 18 is rotated at a prescribed revolution number N1 to drive the hydraulic pump 17, putting the upper die 8 into descending action (ST2,3).

In lowering the ram 6, until slightly before the upper die 8 comes into contact against a workpiece W, the hydraulic oil fed from the hydraulic pump 17 is let through the oil feeding channel 41, the first path 42, and the third path 44 of the hydraulic circuit 40 into the second cylinder chamber 25 in the hydraulic cylinder 12. Thereby, the upper die 8 is lowered at a high speed.

Here, the torque of the servomotor 18 is continuously monitored by the torque detector 67, and the descending position Y of the upper die 8 is monitored by the position transducer 11. The CPU 61 of the control unit 60 obtains a position detecting signal from the position transducer 11, and controls the revolving operation of the servomotor 18 to carry out the position control and the speed control for the upper die 8.

On detection from a position detecting signal of the position transducer 11 that the upper die 8 has reached the speed switching position Y*h* slightly before contacting with the workpiece W, the CPU 61 reduces the number of revolutions of the servomotor 18 from N1 to N2 (N2<N1) to switch the descending action of the upper die 8 from the high speed to the low speed (ST4,5). Here, the hydraulic oil fed from the hydraulic pump 17 is introduced, as in the foregoing case, through the first path 42 into the third path 44, and fed into the second cylinder chamber 25 in the hydraulic cylinder 12.

Subsequently, the upper die 8 comes contacts with the workpiece W immediately after the transition to the low-speed descending action. Here, the torque increases sharply, and a detected value T from the torque detector 67 reaches the aforesaid threshold value $T_{th}$, which results in the "YES" determination at ST6. The CPU 61 adds the aforesaid pressing amount d to the present contact position Y*a* a of the upper die 8 to obtain the lowering terminal position $Y_b$ of the upper die 8, and stores the value in a prescribed area of the RAM 63 (ST7). The contact position Y*a* of the upper die 8 shifts upward for a workpiece of greater thickness and downward for a workpiece of smaller thickness. Accordingly, the lower terminal position $Y_b$ of the upper die 8 is to be automatically adjusted in accordance with the thickness of workpieces.

Once the upper die 8 contacts with the workpiece, the servomotor 18 is increased in number of revolutions from N2 to N1, at ST8. In the meantime, the solenoid change-over valve 52 is switched so that the hydraulic oil fed from the hydraulic pump 17 is sent from the first path 42 through both the third and fourth paths 44, 45 into both of the first and second cylinder chambers 24 and 25 in the hydraulic cylinder 12 (ST8,9). As a result, the upper die 8 remains descending at a low speed to bend the workpiece W between the pressure force from the upper die 8 and the reactive pressure force from the lower die 5.

On detection from a position detecting signal of the position transducer 11 that the upper die 8 reaches the lowering terminal position $Y_b$, the CPU 61 stops the rotation of the servomotor 18 (ST10, 11). Here, in order to stop the rotation of the servomotor 18 just at the lowering terminal position $Y_b$, the CPU 61 has performed a control of gradually reducing the rotation speed of the servomotor 18 before the upper die 8 reaches the lowering terminal position $Y_b$. After a prescribed stop time at the lowering terminal position $Y_b$ the CPU 61 switches the first solenoid change-over valve 50, and issues a rotation command to the servomotor 18 as well (ST12,13). The hydraulic oil from the hydraulic pump 17 is sent through the oil feeding channel 41 to the second path 43, and further sent through the fifth path 46 into the cylinder chamber 26 in the hydraulic cylinder 12. This places the upper die 8 into ascending motion.

Subsequently, when the CPU 61 detects from a position detecting signal of the position transducer 11 that the upper die 8 is lifted up to the standby position Y0, the CPU 61 stops the revolution of the servomotor 18 to stop the feeding of hydraulic oil from the hydraulic pump 17, and then operates the respective solenoid change-over valves 50 and 52 for restoration to their initial states (ST14 to 16).

Figure 11:
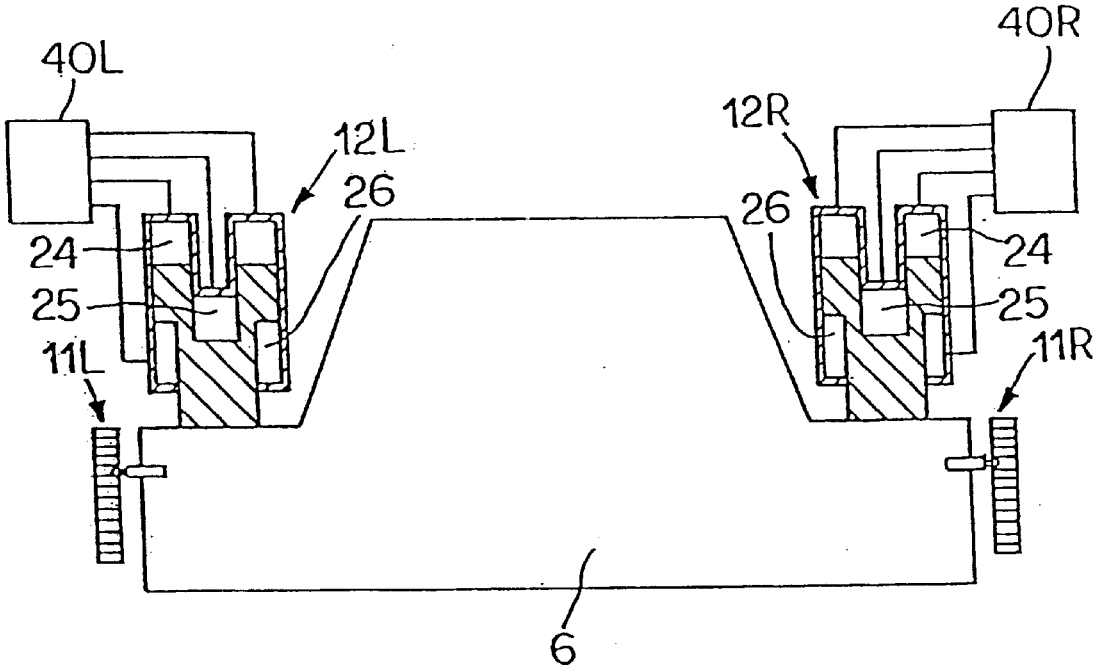
FIG. 11 is a diagram of a structure of a reciprocation mechanism according to a third embodiment.

FIG. 11 shows a press brake according to a third embodiment of the present invention, in which two hydraulic cylinders 12R and 12L are arranged at symmetrical positions on both right and left sides to constitute the reciprocation mechanism 13 for the ram 6.

Each of the hydraulic cylinders 12R and 12L comprises, as in the first embodiment, two cylinder chambers for forward movement 24, 25 a first cylinder chamber and a second cylinder chamber having different cross-sectional areas and a third cylinder chamber for backward movement 26. A first hydraulic circuit 40R is connected with the respective cylinder chambers 24, 25, and 26 in the hydraulic cylinder 12R positioned on the right, and a second hydraulic circuit 40L connected with the respective cylinder chambers 24, 25, and 26 in the hy draulic cylinder 12L positioned on the left to carry out the feeding of hydraulic oil.

Both the first and second hydraulic circuit 40R and 40L are of the same constitution as that of the first embodiment, i.e., that shown in FIG. 3. Inthe hydraulic circuits 40R and 40L are respectively provided hydraulic pumps 17R, 17L for sending out hydraulic oil, ac servomotors 18R, 18L as rotational drive sources of the hydraulic pumps, and the like.

In FIG. 11, designated by 11R and 11L are position transducers for detecting the vertical position of the ram 6 individually at the both right and left sides. On the basis of detected position values at the both right and left sides from the respective position transducers 11R and 11L, controls are given individually on the path switching in the first and second hydraulic circuits 11R and 11L, as well as the revolving operation of the respective servomotors 18R and 18L.

Figure 12:
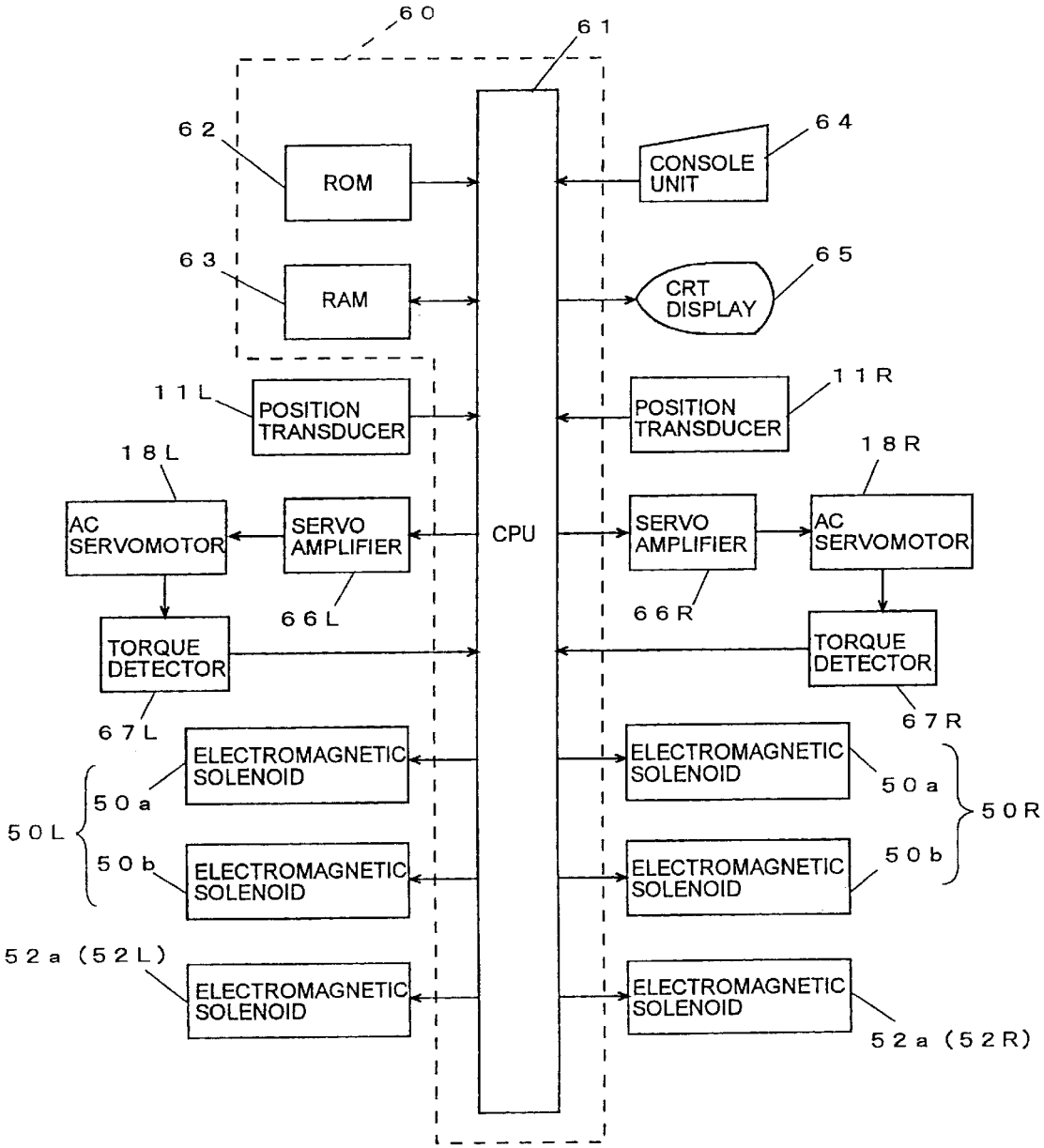
FIG. 12 is a block diagram showing an electrical constitution of the third embodiment.

FIG. 12 shows the electrical constitution of the aforesaid third embodiment. In the figure, designated by 60 is a control unit consisting of a microcomputer, which includes a CPU 61, a ROM 62, and a RAM 63. Designated by 64 is a console unit, and 65 is a CRT display.

In this third embodiment, the CPU 61 supplies servo amplifiers 66R and 66L with outputs for the servomotors 18R and 18L individually in accordance with the hydraulic cylinders 12R and 12L. The servo amplifiers 66R and 66L amplify and feed the outputs to the corresponding ac servomotors 18R and 18L. The servomotors 18R and 18L are connected with torque detectors 67R and 67L, respectively. The torque detectors 67R and 67L, each constituting pressure force detecting means for detecting the pressure force of the upper die 8 with a workpiece, monitor the currents flowing through the ac servomotors 18R and 18L to detect their torque, respectively.

The CPU 61 receives pulsed signals as position detecting signals from respective position transducers 11R and 11L at the both right and left sides. The CPU 61 counts the number of pulses needed to detect the vertical positions of the ram 6 at the both right and left sides individually.

Besides, the CPU 61 outputs drive control signals for controlling the operations of electromagnetic solenoids 50*a*, 50*b* in solenoid change-over valves 50R, 50L, and electromagnetic solenoids 52*a* in second solenoid change-over valves 52R, 52L in the respective hydraulic circuits 40R, 40L.

According to the third embodiment, the hydraulic cylinders 12R and 12L at the both right and left sides can be controlled in operation individually. Therefore, it is possible to separately set the lowering terminal positions of the upper die 8 at both the right and left sides.

Figure 13:
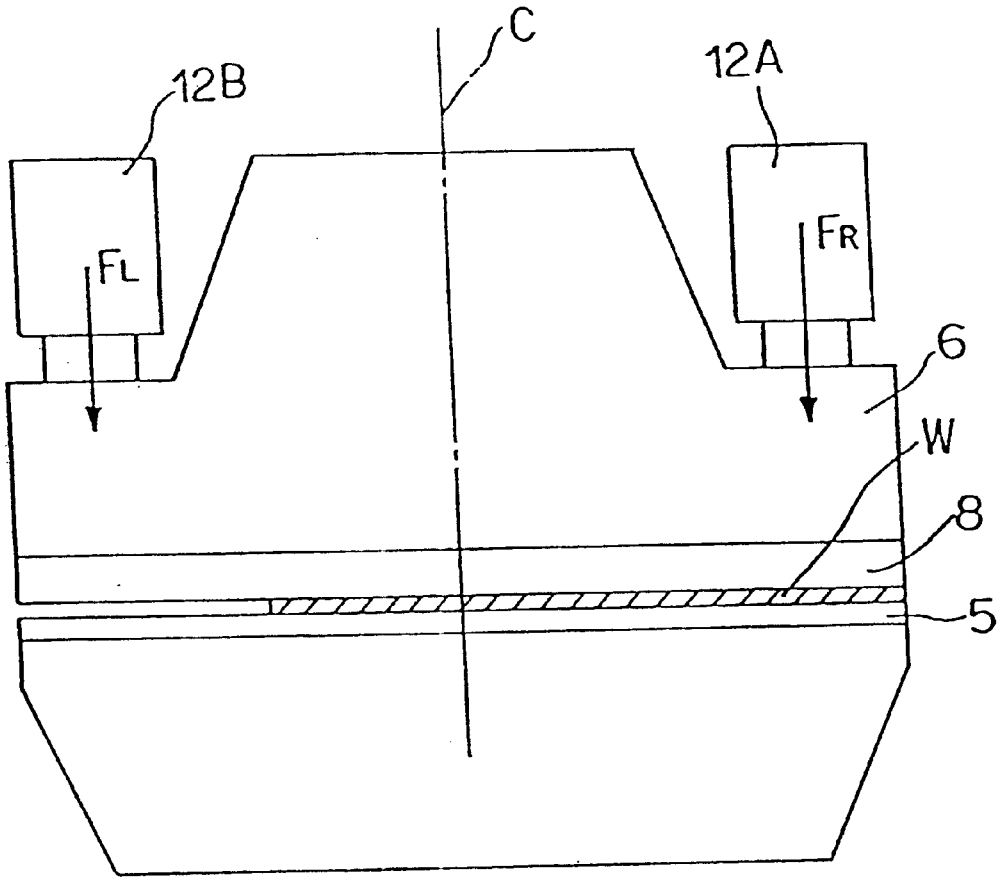
FIG. 13 is a view showing a workpiece set in an unsymmetrical state.

As shown in FIG. 13, if pressurization is applied to a workpiece W being set in an unsymmetrical state to a machine center C, for example, a pressurizing force $F_R$ at one side becomes greater in value than a pressurizing force $F_L$ at the other side. As a result, deformations of the side frames of the machine and of the upper die 8 differ across the right and left sides, which bends the workpiece into non-uniform bending angles, wide on one end and narrow on the other.

In bending a workpiece in accordance with the third embodiment, deformation correction factors representing the relation between a pressure force and deformation of the machine and of the upper die. The deformation correction factors are previously obtained from, e.g., pressure forces and the moved distances of the upper die 8, each measured in performing pressurization with the upper die 8 and the lower die 5 directly contacted against each other. The lowering terminal positions of the upper die 8 are individually corrected at the both sides on the basis of the deformation correction factors and pressurizing forces on the workpiece at the both sides. Therefore, an appropriate bending angle is obtained throughout a workpiece.

Figure 14:
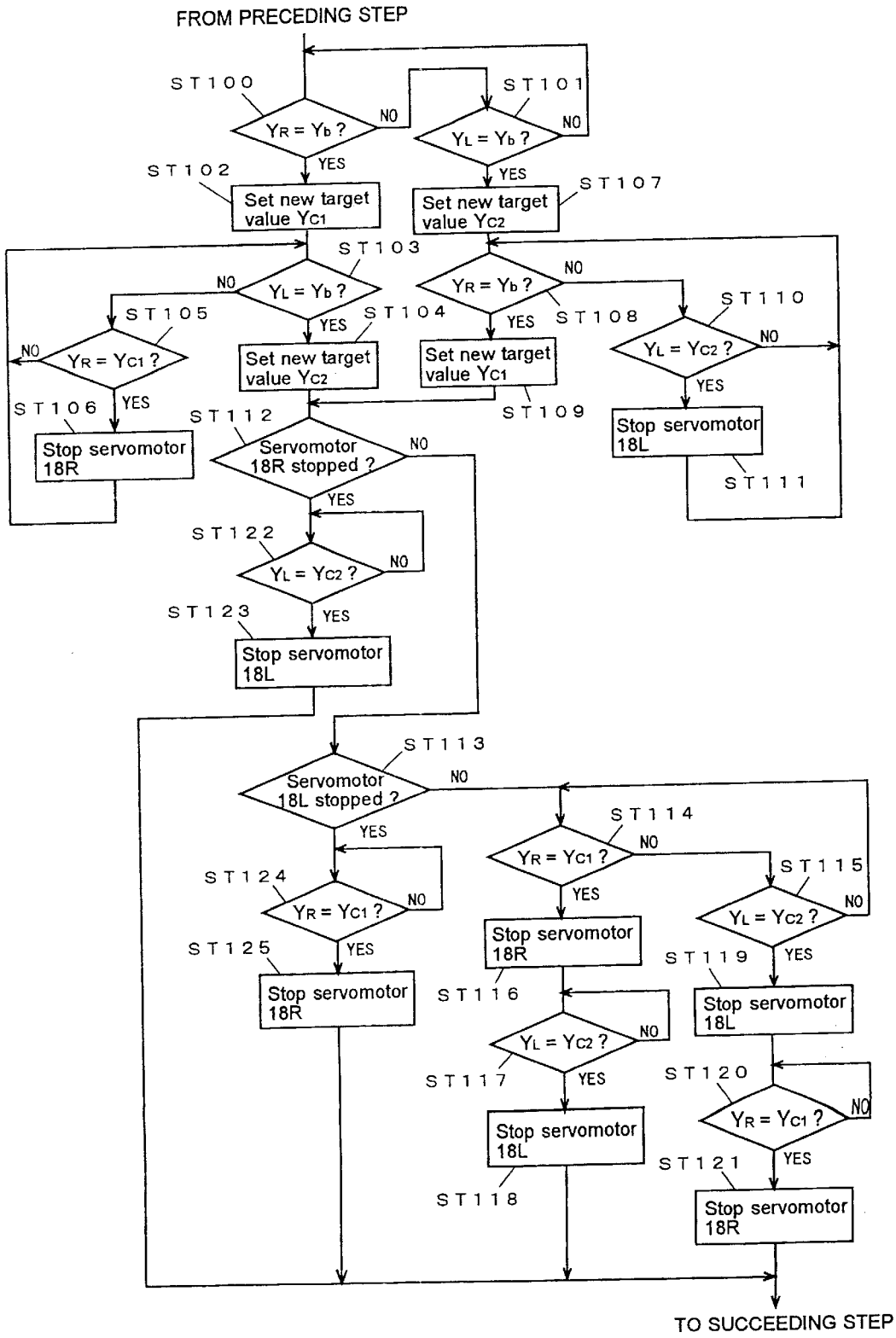
FIG. 14 is a flow chart showing procedures of control by a control unit of the third embodiment.

FIG. 14 shows a flow of control by the aforesaid control unit 60 in the third embodiment. Note that the figure shows only the processing of correcting the lower terminal position of the upper die 8. The other processing is the same as that shown in FIG. 5, and illustrations thereof will be omitted here.

In advance of the bending, an operator inputs prescribed data via the console unit 64 to carry out the initialization. The prescribed data include a lower terminal position of the ram 6 corresponding to the bending angle of the workpiece: $Y_b$ (hereinafter, referred to as "initial target value"), and the above-described deformation correction factors. These input data are taken into the CPU 61, and then stored in the RAM 63.

When the operator steps on foot switch 19 for operation, the ac servomotors 18R and 18L for the hydraulic cylinders 12R and 12L are rotated to drive the hydraulic pumps 17R and 17L, putting the upper die 8 into descending action.

In the descending action of the ram 6, until slightly before the upper die 8 comes into contact against the workpiece W, the hydraulic oils fed from the hydraulic pumps are sent through the hydraulic circuits 40R, 40L into the second cylinder chambers for forward movement 25 in the hydraulic cylinders 12R, 12L, respectively. Thereby, the upper die 8 is lowered at a high speed.

Here, the descending position of the upper die 8 is continuously monitored by the position transducers 11R and 11L at the both right and left sides. The CPU 61 in the control unit 60 obtains position detecting signals from the respective position transducers 11R and 11L, and controls the respective revolving operations of the servomotors 18R and 18L to carry out the position control and the speed control for the upper die 8.

On detection from a position detecting signal of either the position transducer 11R or 11L the fact that the upper die 8 has reached the speed switching position $Y_h$ slightly before contacting with the workpiece W, the CPU 61 actuates the solenoid change-over valves 52R and 52L in the respective hydraulic circuits 40R and 40L to change over. By this means, the hydraulic oils fed from the hydraulic pumps 17R and 17L are introduced into the both cylinder chambers for forward movement 24, 25 in the hydraulic cylinders 12R and 12L, respectively. This switches the descending action of the upper die 8 from a high speed to a low speed.

Immediately after the transition of the descending action to the low speed, the upper die 8 comes into contact against the workpiece W. Then, the workpiece W is bent between the pressure force from the upper die 8 and a reactive pressure force from the lower die 5.

Note that the above-described flow of control is substantially the same as that of the first embodiment shown in FIG. 5 (ST1 to ST5).

Now, assuming that the CPU 61 firstly detects the arrival of the upper die 8 to the initial target value $Y_b$ on the basis of a position detecting signal from the right position transducer 11R, the descending position $Y_R$ at the right side of the upper die 8 becomes equal to $Y_b$, which results in the "YES" determination at the ST100 in FIG. 14. Here, the CPU 61 obtains the value of the pressurizing force at that point from the torque detector 67R, multiplies the value of the pressure force with the aforesaid deformation correction factor, adds the resultant value (correction value) to the initial target value $Y_b$ to obtain a new lower terminal position to be targeted (hereinafter, referred to as "new target value") $Y_{c1}$ (ST102).

At the succeeding ST103, when the CPU 61 detects from a position detecting signal of the left position transducer 11L the fact that the upper die 8 has reached the initial target value $Y_b$, the descending position $Y_L$ at the left side of the upper die 8 becomes equal to $Y_b$, which results in the "YES" determination at ST103. The CPU 61 obtains the value of the pressure force at that point from the torque detector 67L, multiplies the value of the pressure force with the aforesaid deformation correction factor, and adds the obtained correction value to the initial target value $Y_b$ to obtain a new target value $Y_{c2}$ (ST104).

In this connection, in cases where the CPU 61 detects the arrival of the upper die 8 to the new target value $Y_{c1}$. from a detected position detecting signal of the right position transducer 11R before the "YES" determination is made at the aforesaid ST103, the determination at ST105 becomes "YES," so that the CPU 61 stops the revolution of the servomotor 18R (ST106).

On the other hand, in the cases where the CPU 61 firstly detects from a position detecting signal of the left position transducer 11L the fact that the upper die 8 has reached the initial target value $Y_b$, the determination at ST100 becomes "NO," and the determination at ST101 "YES." Accordingly, the CPU 61 obtains the value of the pressure force at that point from the torque detector 67L, multiplies the value of the pressurizing force with the deformation correction factor, and adds the obtained correction value to the initial target value $Y_b$ to obtain a new target value $Y_{c2}$ (ST107).

At the succeeding ST108, when the CPU 61 detects from a position detecting signal of the right position transducer 11R the fact that the upper die 8 has reached the initial target value $Y_b$, the determination at ST108 is "YES." In this case, the CPU 61 obtains the value of the pressure force at that point from the torque detector 67R, multiplies the value of the pressure force with the deformation correction factor, and adds the obtained correction value to the initial target value $Y_b$ to obtain a new target value $Y_{c1}$ (ST109).

Note that, in cases where the CPU 61 detects the arrival of the upper die 8 to the new target value $Y_{c2}$ from a detected position detecting signal of the left position transducer 11L before the "YES " determination is made at the aforesaid ST108, the determination at ST110 becomes "YES," so that the CPU 61 stops the revolution of the servomotor 18L (ST111).

Subsequently, under a condition where both the servomotors 18R and 18L are running, both the succeeding ST112 and ST113 result in "NO," keeping the CPU 61 on standby until the upper die 8 reaches the new target values $Y_{c1}$, $Y_{c2}$ at ST114, 115.

In this standby, when the CPU 61 detects from a position detecting signal of the right position transducer 11R that the upper die 8 has reached the new target value $Y_{c1}$, the determination at ST114 becomes "YES," so that the CPU 61 stops the revolution of the servomotor 18R (ST116). Thereafter, when the CPU 61 detects from a position detecting signal of the left position transducer 11L that the upper die 8 has reached the new target value $Y_{c2}$, the determination at ST117 becomes "YES," and the CPU 61 stops the revolution of the servomotor 18L (ST118).

During the standby at ST114 and ST115, in the case where the CPU 61 detects from a position detecting signal of the left position transducer 11L that the upper die 8 has reached the new target value $Y_{c2}$, the determination at ST115 becomes "YES," so that the CPU 61 stops the revolution of the servomotor 18L (ST119). Thereafter, when the CPU 61 detects from aposition detecting signal of the right position transducer 11R that the upper die 8 has reached the new target value $Y_{c1}$, the determination at ST120 becomes "YES," and the revolution of the servomotor 18R is stopped (ST121).

Note that, in the cases where the servomotor 18R is stopped at ST106 before the setting of the new target value $Y_{c2}$ at the aforesaid ST104, the process proceeds from ST104 through ST112 to ST122. Here, the arrival of the upper die 8 to the new target value $Y_{c2}$ leads to the "YES" determnination at ST122, so that the servomotor 18L is stopped at ST123.

Moreover, in the cases where the servomotor 18L is stopped at ST111 before the setting of the new target value YC1 at ST109, the process proceeds from ST109 through ST112, 113 to ST124. Here, the arrival of the upper die 8 to the new target value $Y_{c1}$ results in the "YES" determination at ST124 to stop the servomotor 18R at ST125.

The suspension of the both servomotors 18R and 18L stops the descending of the ram 6. After a prescribed stop time, the CPU 61 actuates both the solenoid change-over valves 50R, 50L in the hydraulic circuits 40R, 40L to change over, and issues rotation commands to the respective servomotors 18R, 18L as well. The hydraulic oils from the hydraulic pumps 17R, 17L are sent through the hydraulic circuits 40R, 40L into the cylinder chambers 26 in the hydraulic cylinders 12R, 12L, respectively. This places the upper die 8 into ascending motion.

Subsequently, on detecting from a position detecting signal of either the position transducer 11R or 11L that the upper die 8 is lifted up to the standby position $Y_0$, the CPU 61 stops the revolution of the both servomotors 18R, 18L to stop the feeding of hydraulic oils from the hydraulic pumps 17R, 17L. Then, the CPU 61 operates the first and second solenoid change-over valves 50R, 50L, 52R, and 52L for restoration to their initial states.

Note that the flow of control for lifting the upper die 8 is substantially the same as that of the first embodiment shown in FIG. 5 (ST8 to ST12).

Figure 15:
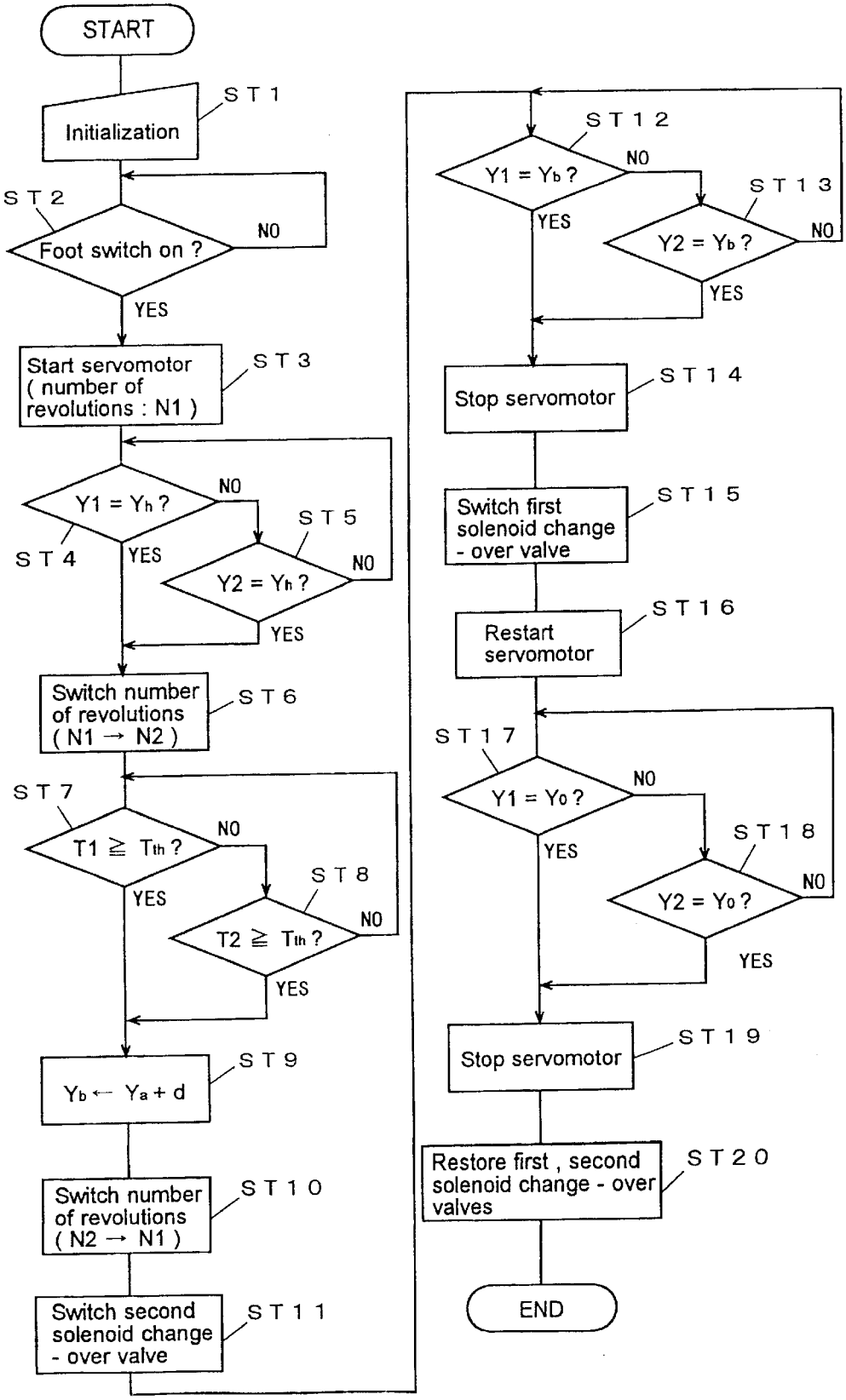
FIG. 15 is a flow chart showing procedures of control by a control unit of a forth embodiment.

A fourth embodiment of the present invention is a press brake of a type containing the hydraulic cylinders 12R and 12L on the both right and left sides, respectively, and having a function of detecting the thickness of a workpiece and a function of correcting the lower terminal position of the upper die 8. FIG. 15 shows the control procedure for a press brake to be conducted by the CPU 61 of the aforesaid control unit 60 in the fourth embodiment. Note that the fourth embodiment is of the same constitution as that shown in FIGS. 11 and 12, and description thereto will be omitted here.

In this connection, FIG. 15 illustrates, for ease of description, only the control procedure for detecting the thickness of a workpiece and for correcting errors resulting from deviation in thickness; and it is apparent that the correction of uneven-load-originated errors, which has been described in detail with reference to FIG. 14, is also applicable.

Now, the flow of control by the CPU 611n the fourth embodiment will be described in accordance with FIG. 15. In advance of the bending, an operator inputs prescribed data via the console unit 64 to carry out the initialization (ST1). The prescribed data include a threshold value $T_{th}$ for use in determining the contact of the upper die 8 against the workpiece, and a pressing amount d of the upper die 8 for obtaining a desired bending angle. These input data are taken into the CPU 61, and then stored in the RAM 63.

When the operator steps on the foot switch 19 to operate, the servomotors 18R and 18L for the hydraulic cylinders 12R and 12L are respectively rotated at a prescribed revolution number N1 to drive the hydraulic pumps 17R and 17L, putting the upper die 8 into descending action (ST2,3).

In lowering the ram 6, until slightly before the upper die 8 comes into contact against a workpiece W, the hydraulic oils fed from the hydraulic pumps 17R, 17L are introduced through the hydraulic circuits 40R, 40L into the cylinder chambers 25 of smaller cross-sectional area in the hydraulic cylinders 12R, 12L, respectively. Thereby, the upper die 8 is lowered at a high speed.

Here, the torque of the respective servomotors 18R, 18L is continuously monitored by the corresponding torque detectors 67R, 67L, and the descending positions $Y_1$, $Y_2$ of the upper die 8 monitored by the position transducers 11R, 11L at the both right and left sides, respectively. The CPU 61 in the control unit 60 obtains position detecting signals from the position transducers 11R and 11L, and controls the revolving operations of the respective servomotors 18R and 18L to carry out the position control and the speed control for the upper die 8.

On detection from a position detecting signal of either the position transducer 11R or 11L the fact that the upper die 8 has reached the speed switching position Y*h* slightly before contacting against the workpiece W, the CPU 61 reduces the number of revolutions of the servomotors 18R and 18L from N1 to N2 (N2<N1) to switch the descending action of the upper die 8 from the high speed to the low speed (ST4 to 6). Here, the hydraulic oils fed from the hydraulic pumps 17R and 17L are respectively introduced, as in the foregoing cases, through the first paths 42 into the third paths 44, and fed into the cylinder chambers 25 in the respective hydraulic cylinders 12R and 12L.

Subsequently, the upper die 8 comes to contact against the workpiece W immediately after the transition to the low-speed descending action. Here, the torque increases sharply, and a detected value T1 or T2 from either the torque detector 67R or 67L reaches the aforesaid threshold value $T_{th}$, which leads to the "YES" determination at ST7 or ST8. Then, the CPU 61 adds the aforesaid pressing amount d to the present contact position Y*a* of the upper die 8 to obtain the lower terminal position $Y_b$ of the upper die 8, and stores the value in a prescribed area of the RAM 63 (ST9). The contact position Y*a* of the upper die 8 shifts upward for a workpiece of greater thickness and downward for a workpiece of smaller thickness. Accordingly, the lower terminal position $Y_b$ of the upper die 8 is to be automatically adjusted in accordance with the thickness of workpieces.

Once the upper die 8 comes to contact against the workpiece, the respective servomotors 18R and 18L are increased in number of revolutions from N2 to N1, at ST10. Meanwhile, the solenoid change-over valves 52R and 52L are switched so that the hydraulic oils fed from the respective hydraulic pumps 17R and 17L are introduced into both the first and second cylinder chambers 24 and 25 in the respective hydraulic cylinders 12R and 12L (ST11). As a result, the upper die 8 is kept descending at the low speed to bend the workpiece W between the pressure force from the upper die 8 and the reactive pressure force from the lower die 5.

On detection from a position detecting signal of either the position transducer 11R or 11L that the upper die 8 has reached the lower terminal position $Y_b$, the CPU 61 stops the rotation of the servomotor 18R and 18L (ST12 to 14).

After a prescribed stop time at the lower terminal position $Y_b$, the CPU 61 switches the solenoid change-over valves 50R and 50L, and issues rotation commands to the respective servomotors 18R and 18L as well (ST15, 16). The hydraulic oils from the hydraulic pumps 17R and 17L are sent into the cylinder chambers 26 in the hydraulic cylinders 12R and 12L, respectively. This puts the upper die 8 into ascending action.

Subsequently, when the CPU 61 detects from a position detecting signal either the position transducer 11R or 11L that the upper die 8 is lifted up to the standby position Y0, the CPU 61 stops the revolution of the servomotors 18R, 18L to stop the feeding of the hydraulic oils from the hydraulic pumps 17R, 17L, and then operates the first and second solenoid change-over valves 50R, 50L, 52R, and 52L for restoration to their initial states (ST17 to 20).

Figure 16:
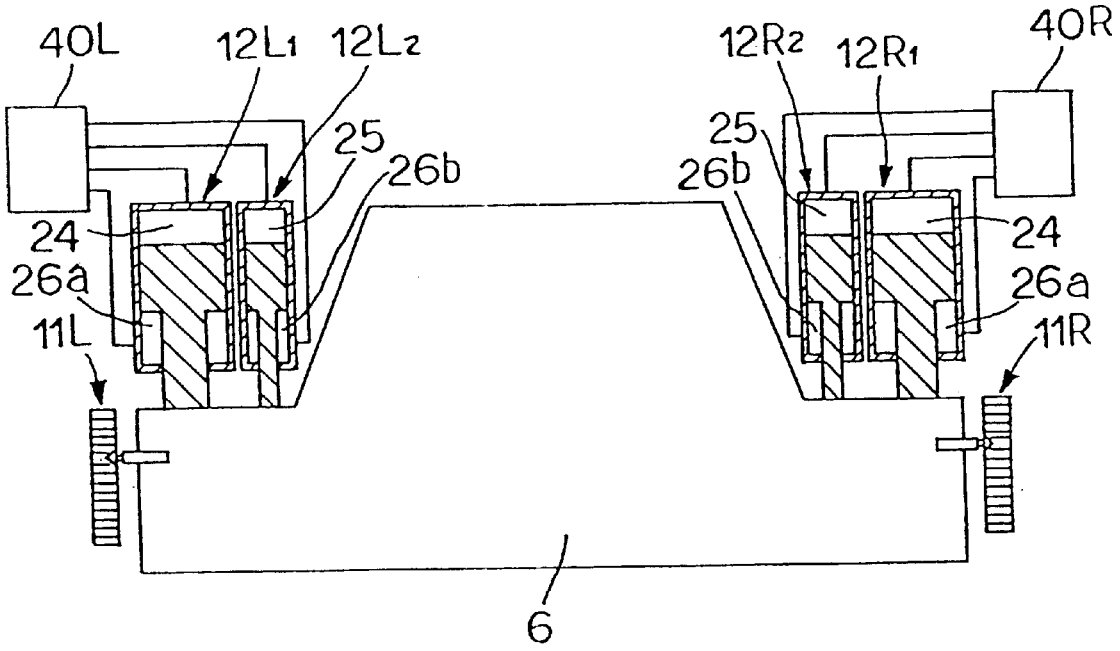
FIG. 16 is a diagram of a structure of a reciprocation mechanism according to a fifth embodiment.

FIG. 16 shows the constitution of a press brake according to a fifth embodiment of the present invention, in which large and small four hydraulic cylinders 12R1, 12L1, 12R2, and 12L2 are arranged in twos at symmetrical positions on both right and left sides to constitute the reciprocation mechanism 13 for the ram 6.

Among the fourhydraulic cylinders 12R1, 12L1, 12R2, and 12L2, each of the hydraulic cylinders 12R1 and 12L1 comprises a cylinder chamber 24 of large cross-sectional area and a cylinder chamber 26*a*. Meanwhile, each of the remaining hydraulic cylinders 12R2 and 12L2 comprises a cylinder chamber 25 and a cylinder chamber 26*b*. Here, the cylinder chambers 25 are formed to have a cross-sectional area smaller than that of the cylinder chambers 24 in the aforesaid hydraulic cylinders $12R_1$ and $12L_1$.

The respective cylinder chambers 24, 25, 26*a*, and 26*b* in the hydraulic cylinders $12R_1$ and $12R_2$ at the right side are connected with a first hydraulic circuit 40R, and the respective cylinder chambers 24, 25, 26*a*, and 26*b* in the hydraulic cylinders $12L_1$ and $12L_2$ at the left side are connected with a second hydraulic circuit 40L to conduct the feeding of hydraulic oils.

The first and second hydraulic circuits 40R and 40L are of the same constitution as that in the first embodiment, in other words, of the same constitution as that shown in FIG. 3. That is, the hydraulic circuits 40L, 40R are provided with such components as hydraulic pumps 17R, 17L for sending out hydraulic oil and ac servomotors 18R, 18L as rotational drive sources of the hydraulic pumps, respectively.

Besides, in FIG. 16, designated by 11R and 11L are position transducers for detecting the lifting position of the ram 6 individually at both right and left sides. On the basis of position detected values at the both right and left sides from the position transducers 11R and 11L, controls are given individually on the path switching of the first and second hydraulic circuits 40R and 40L, and on the respective revolving operations of the servomotors 18R and 18L.

This press brake of the fifth embodiment can also be controlled in actions of the hydraulic cylinders 12R and 12L at the both right and left sides individually. This makes it possible to correct the errors resulting from deflection of the machine and that of the upper die caused by the uneven load of a workpiece. Besides, it is possible to provide a function of detecting the thickness of a workpiece and a function of correcting errors resulting from deviation in thickness.

Figure 17:
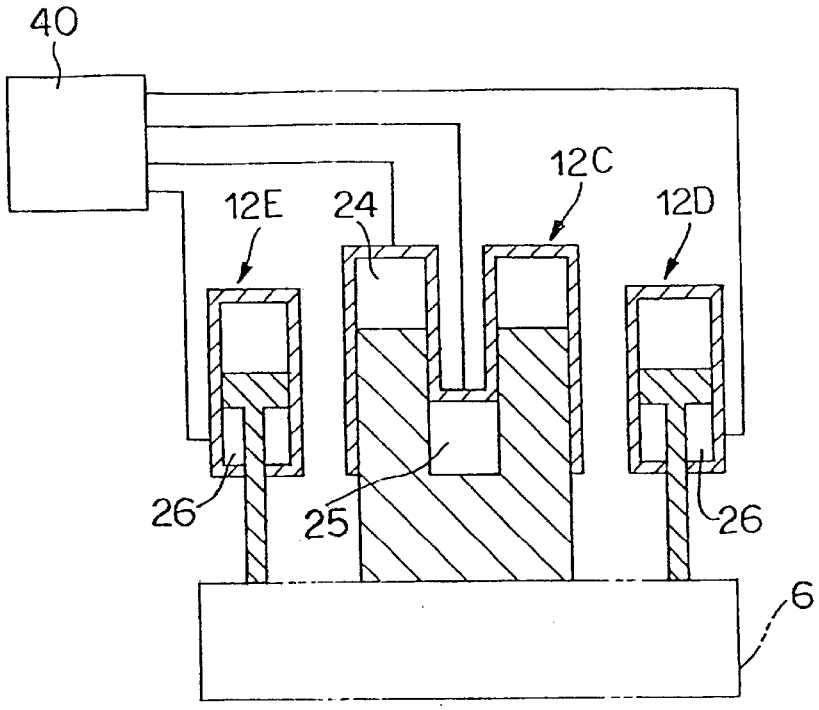
FIGS. 17 to 21 are diagrams showing a reciprocation mechanism according to another embodiment.
Figure 18:
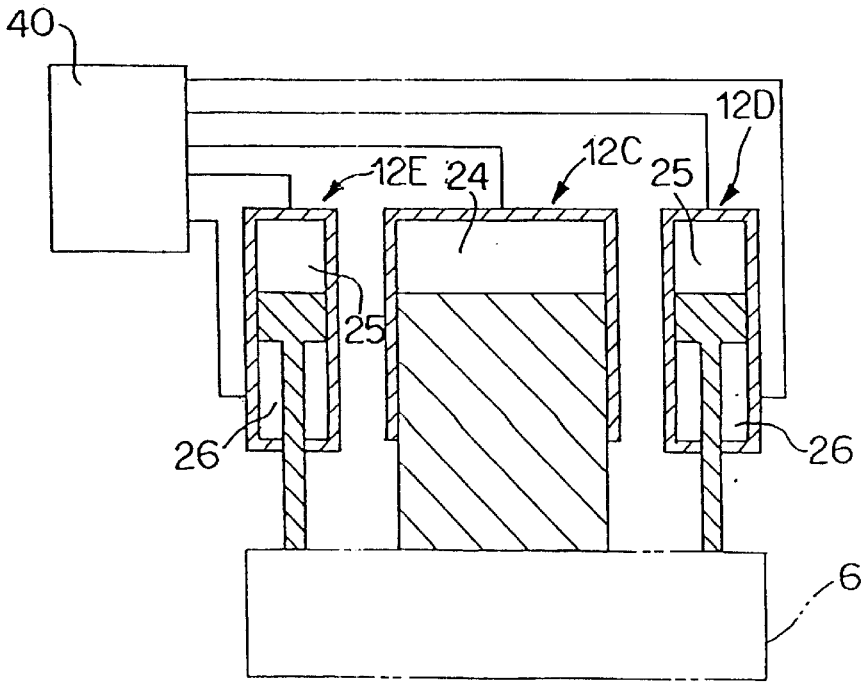
Figure 19:
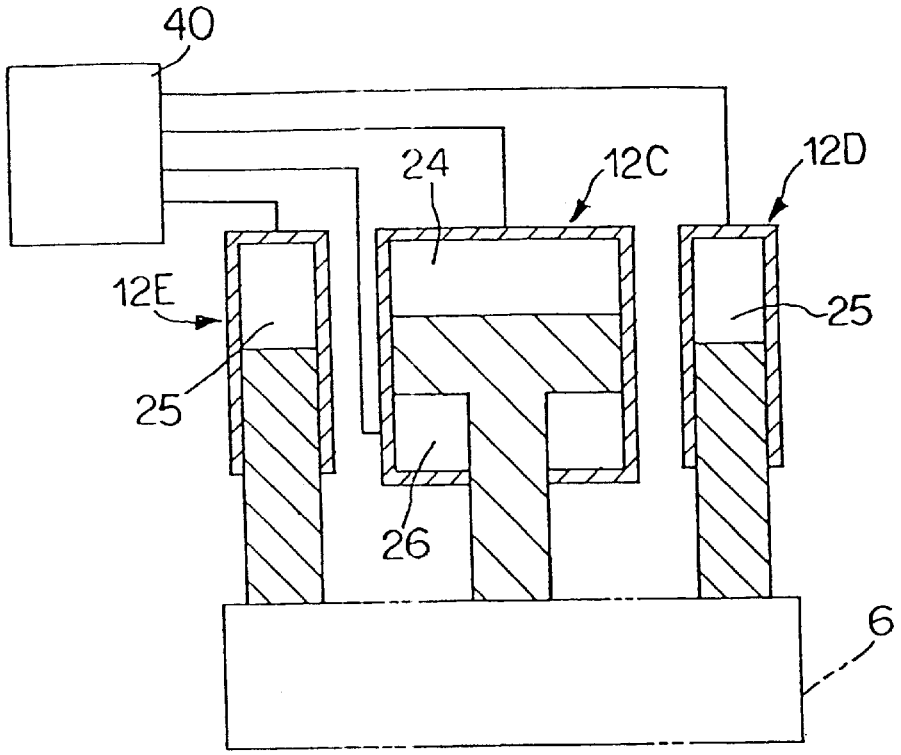
Figure 20:
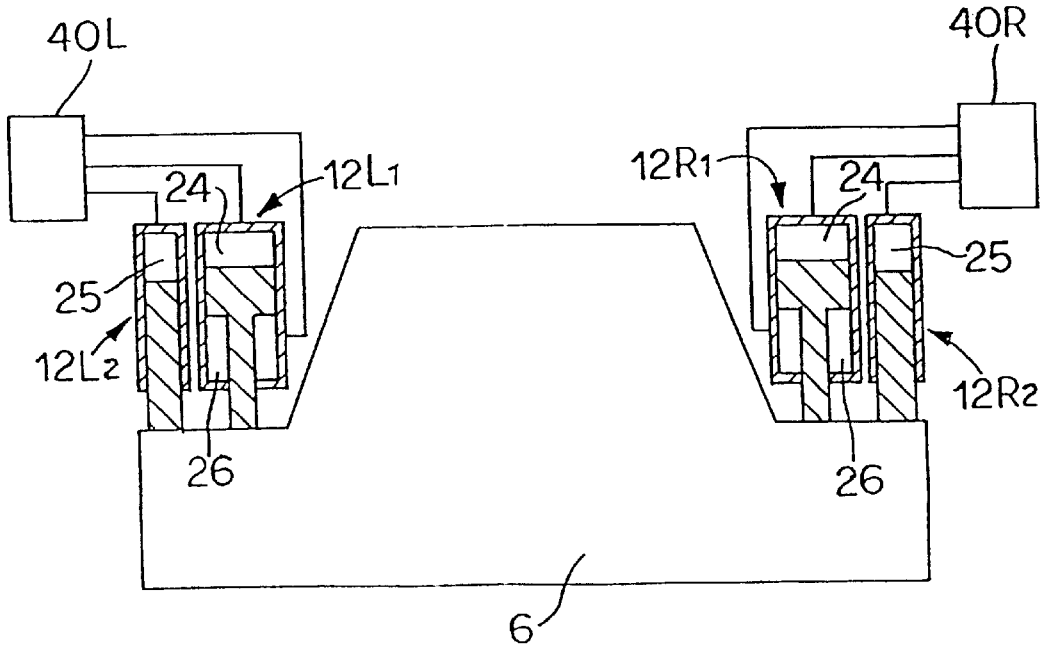
Figure 21:
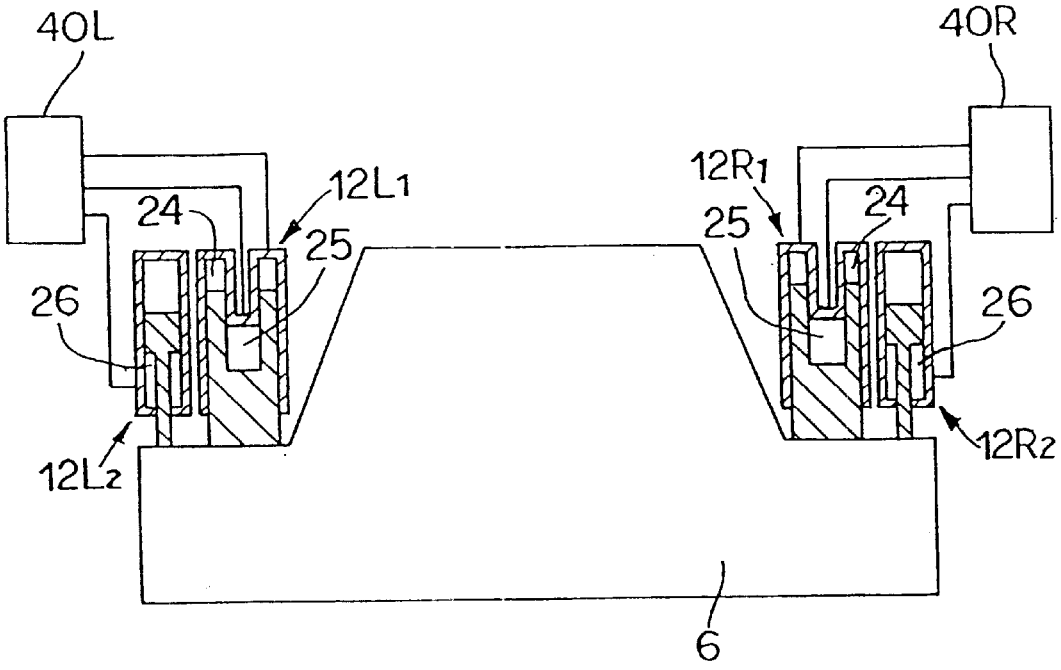

Note that a reciprocation mechanism 13 to be arranged at the central portion of a machine may be constituted as shown in FIGS. 17 to 19 as long as the first and second cylinder chambers 24 and 25 having different cross-sectional areas and the cylinder chamber 26 are provided. As for a type to be arranged on the both right and left sides of a machine, a reciprocation mechanism 13 may be constituted as shown in FIGS. 20 and 21 as long as the first and second cylinder chambers 24 and 25 having different cross-sectional areas and the cylinder chamber 26 are provided on each of symmetrical positions at both right and left sides.

The reciprocation mechanism 13 shown in FIG. 17 is composed of three hydraulic cylinders 12C, 12D, and 12E. The central hydraulic cylinder 12C is provided with a cylinder chamber 24 of large cross-sectional area and a cylinder chamber 25 of small cross-sectional area. The hydraulic cylinders 12D and 12E at the both sides are respectively provided with cylinder chambers 26.

The reciprocation mechanism 13 shown in FIG. 18 is also composed of three hydraulic cylinders 12C, 12D, and 12E. The central hydraulic cylinder 12C is provided with a cylinder chamber 24 of large cross-sectional area. The hydraulic cylinders 12D and 12E at the both sides are respectively provided with cylinder chambers 25 of small cross-sectional area and cylinder chambers 26.

The reciprocation mechanism 13 shown in FIG. 19 is also composed of three hydraulic cylinders 12C, 12D, and 12E. The central hydraulic cylinder 12C is provided with a cylinder chamber 24 of large cross-sectional area and a cylinder chamber 26. The hydraulic cylinders 12D and 12E at the both sides are respectively provided with cylinder chambers 25 of small cross-sectional area.

The reciprocation mechanism 13 shown in FIG. 20 comprises large and small four hydraulic cylinders $12R_1$, $12L_1$, $12R_2$, and $12L_2$ arranged in twos at symmetrical positions on both right and left sides. Among these hydraulic cylinders, the hydraulic cylinders $12R_1$ and $12L_1$ are respectively provided with cylinder chambers 24 of large cross-sectional area and cylinder chambers 26. The remaining hydraulic cylinders $12R_2$ and $12L_2$ are respectively provided with cylinder chambers 25 of small cross-sectional area.

The reciprocation mechanism 13 shown in FIG. 21 also comprises large and small four hydraulic cylinders $12R_1$, $12L_1$, $12R_2$, and $12L_2$ arranged in twos at symmetrical positions on both right and left sides. Among these hydraulic cylinders, the hydraulic cylinders 12R1 and 12L1 are respectively provided with cylinder chambers 24 of large cross-sectional area and cylinder chambers 25 of small cross-sectional area. The remaining hydraulic cylinders $12R_2$ and $12L_2$ are respectively provided with cylinder chambers 26.

What is claimed is:

1. A hydraulic machine comprising:

a reciprocation mechanism including a cylinder unit having a first cylinder chamber and a second cylinder chamber having different cross-sectional areas for movement in a first direction, and a third cylinder chamber for movement in a second direction;

a hydraulic circuit including a plurality of paths for feeding hydraulic oil into respective ones of the first, second and third cylinder chambers in the cylinder unit;

a hydraulic pump for sending hydraulic oil to the hydraulic circuit;

a servomotor for driving said hydraulic pump;

a position detecting means for detecting position of reciprocation movement due to the reciprocation mechanism; and a control means for controlling path switching in the hydraulic circuit to direct the hydraulic oil and controlling revolving operation of the servomotor to effect pressure control based on a position value detected by the position detecting means.

2. The hydraulic machine according to the claim 1, further comprising a die that reciprocates on said reciprocation mechanism to apply pressure to a workpiece.

3. The hydraulic machine according to claim 1, further comprising a fourth cylinder chamber.

4. A hydraulic machine comprising:

a reciprocation mechanism including a cylinder unit having a first cylinder chamber and a second cylinder chamber having different cross-sectional areas for movement in a first direction, and a third cylinder chamber for movement in a second direction;

a hydraulic circuit including a plurality of paths for feeding hydraulic oil into respective ones of the first, second and third cylinder chambers in the cylinder unit;

a hydraulic pump for sending hydraulic oil to the hydraulic circuit;

a servo motor for driving said hydraulic pump;

a position detecting means for detecting position of reciprocation movement due to the reciprocation mechanism;

a control means for controlling path switching in the hydraulic circuit to direct the hydraulic fluid and controlling revolving operation of the servo motor to effect pressure control based on a position value detected by the position detecting means to effect pressure control;

a die for applying pressure and bending a workpiece at a prescribed angle, said die being reciprocated by said reciprocation mechanism;

a pressure force detecting means for detecting a pressure force effected from the die to the workpiece;

a thickness detecting means for detecting contact of the die with the workpiece by comparing a pressure value detected by the pressure force detecting means with a prescribed threshold, and detecting a thickness of the workpiece by using the position value detected by said position detecting means on detecting the contact of the die with the workpiece; and said control means determining a shift of a terminal position of the die according to the thickness of the workpiece detected by said thickness detecting means, and stopping the revolution of the servomotor when the position value detected by the position detecting means arrives at the terminal position.

5. A hydraulic machine comprising:

a reciprocation mechanism including a pair of cylinder units which are arranged at symmetrical positions on both sides of the machine; each cylinder unit having a first cylinder chamber and a second cylinder chamber having different cross-sectional areas for movement in a first direction, and a third cylinder chamber for movement in a second direction;

a pair of hydraulic circuits connected with the cylinder units respectively, each circuit including a plurality of paths for feeding hydraulic oil into respective ones of the first second and third cylinder chambers in the corresponding cylinder unit;

a pair of hydraulic pumps for sending hydraulic oil to the hydraulic circuits respectively;

a pair of servomotors for driving the hydraulic pumps respectively;

a position detecting means for detecting shifting positions of reciprocation movement effected by respective ones of the cylinder units; and a control means for controlling individually path switching in the respective hydraulic circuits to direct the hydraulic fluid and controlling revolving operations of the respective servomotors based on position values detected by the position detecting means to effect pressure control.

6. The hydraulic machine according to the claim 5 further comprising a die that reciprocates on said reciprocation mechanism to apply pressure to a workpiece.

7. The hydraulic machine according to the claim 5, further comprising:

a die for applying pressure and bending a workpiece at a prescribed angle, said die reciprocating on said reciprocation mechanism;

a pressure force detecting means for detecting pressure forces effected from the die to the workpiece by respective ones of said pair of cylinder units;

a thickness detecting means for detecting contact of the die with the workpiece by comparing a pressure value detected by the pressure force detecting means with a prescribed threshold, and detecting a thickness of the workpiece by using the position values detected by said position detecting means on detecting the contact of the die with the workpiece; and said control means determining a shift of a terminal position of the die according to the thickness of the workpiece detected by said thickness detecting means, and stopping the revolutions of respective ones of the servomotors corresponding to respective ones of the pair of cylinder units when the corresponding position values detected by the position detecting means arrives at the terminal position.

8. The hydraulic machine according to claim 5, further comprising a fourth cylinder chamber.

9. A hydraulic machine comprising:

a reciprocation mechanism including a cylinder unit having a cylinder chamber for movement;

a hydraulic circuit for feeding hydraulic oil into the cylinder chambers in the cylinder unit;

a hydraulic pump for sending hydraulic oil to the hydraulic circuit;

a servomotor for driving said hydraulic pump;

a position detecting means for detecting position of reciprocation movement due to the reciprocation mechanism; and a control means for controlling path switching in the hydraulic circuit to direct the hydraulic oil and controlling revolving operation of the servomotor to effect pressure control based on a position value detected by the position detecting means.

10. The hydraulic machine according to the claim 9, further comprising a die that reciprocates on said reciprocation mechanism to apply pressure to a workpiece.

11. The hydraulic machine according to the claim 9, further comprising:

a die for applying pressure and bending a workpiece at a prescribed angle, said die reciprocating on said reciprocation mechanism;

a pressure force detecting means for detecting a pressure force effected from the die to the workpiece;

a thickness detecting means for detecting contact of the die with the workpiece by comparing a pressure value detected by the pressure force detecting means with a prescribed threshold, and detecting a thickness of the workpiece by using the position value detected by said position detecting means on detecting the contact of the die with the workpiece; and said control means determining a shift of a terminal position of the die according to the thickness of the workpiece detected by said thickness detecting means, and stopping the revolution of the servomotor when the position value detected by the position detecting means arrives to the terminal position.

12. A hydraulic machine comprising:

a reciprocation mechanism comprising a cylinder unit having a first cylinder chamber and a second cylinder chamber having different cross-sectional areas, and a third cylinder chamber;

a hydraulic circuit comprising a plurality of paths for feeding hydraulic oil into respective ones of the first, second and third cylinder chambers in the cylinder unit;

a hydraulic pump for sending hydraulic oil to the hydraulic circuit;

a servomotor for driving said hydraulic pump;

a position detecting means for detecting position of reciprocation movement due to the reciprocation mechanism; and a control means for controlling path switching in the hydraulic circuit to direct the hydraulic oil and controlling revolving operation of the servomotor to effect pressure control based on a position value detected by the position detecting means.

13. The hydraulic machine according to the claim 12, further comprising a die that reciprocates on said reciprocation mechanism to apply pressure to a workpiece.

14. The hydraulic machine according to the claim 12 further comprising:

a die reciprocated by said reciprocation mechanism to apply pressure to and bend a workpiece at a prescribed angle;

a pressure force detecting means for detecting a pressure force effected from the die to the workpiece;

a thickness detecting means for detecting the contact of the die with the workpiece by comparing a pressure value detected by the pressure force detecting means with a prescribed threshold, and detecting a thickness of the workpiece by using the position value detected by said position detecting means on detecting the contact of the die with the workpiece; and said control means determining a shift of a terminal position of the die according to the thickness of the workpiece detected by said thickness detecting means, and stopping the revolution of the servomotor when the position value detected by the position detecting means arrives to the terminal position.

* * * * *